US007217483B2

(12) United States Patent
Nozomi et al.

(10) Patent No.: US 7,217,483 B2
(45) Date of Patent: May 15, 2007

(54) ELECTROPHOTOGRAPHIC PHOTORECEPTOR, DRUM CARTRIDGE EMPLOYING THE ELECTROPHOTOGRAPHIC PHOTORECEPTOR, AND IMAGE-FORMING APPARATUS

(75) Inventors: Mamoru Nozomi, Chesapeake, VA (US); Kazutaka Ida, Kanagawa (JP); Mitsuo Wada, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 11/150,271

(22) Filed: Jun. 13, 2005

(65) Prior Publication Data

US 2006/0068310 A1 Mar. 30, 2006

Related U.S. Application Data

(63) Continuation of application No. PCT/JP03/15967, filed on Dec. 12, 2003.

(30) Foreign Application Priority Data

Dec. 13, 2002 (JP) ..... P. 2002-362325

(51) Int. Cl.
*G03G 5/00* (2006.01)

(52) U.S. Cl. ..... 430/96; 430/73; 430/78; 430/84

(58) Field of Classification Search ..... 430/96, 430/78, 73, 84
See application file for complete search history.

(56) References Cited

U.S. PATENT DOCUMENTS

| | | | |
|---|---|---|---|
| 4,751,163 | A | 6/1988 | Hagiwara et al. |
| 5,024,912 | A | 6/1991 | Neishi et al. |
| 5,098,809 | A | 3/1992 | Kikuchi et al. |
| 6,482,560 | B2 | 11/2002 | Mitsumori et al. |
| 6,599,671 | B2 | 7/2003 | Mitsumori et al. |
| 6,803,163 | B2 | 10/2004 | Mitsumori et al. |
| 6,884,556 | B2 | 4/2005 | Kumano et al. |
| 2003/0054270 | A1 | 3/2003 | Buettner et al. |

FOREIGN PATENT DOCUMENTS

| | | |
|---|---|---|
| JP | 57-192959 | 11/1982 |
| JP | 58-32372 | 7/1983 |
| JP | 58-198043 | 11/1983 |
| JP | 63-274958 | 11/1988 |
| JP | 63-287954 | 11/1988 |
| JP | 1-180550 | 7/1989 |
| JP | 1-213665 | 8/1989 |
| JP | 3-55558 | 3/1991 |
| JP | 5-323631 | 12/1993 |
| JP | 07-191476 | 7/1995 |
| JP | 10-048856 | 2/1998 |
| JP | 10-312070 | 11/1998 |
| JP | 10-312072 | 11/1998 |
| JP | 2002-189308 | 7/2002 |
| JP | 2002-214810 | 7/2002 |
| JP | 2002-296816 | 10/2002 |

*Primary Examiner*—Mark A. Chapman
(74) *Attorney, Agent, or Firm*—Oblon, Spivak, McClelland, Maier & Neustadt, P.C.

(57) ABSTRACT

The present invention provides an electrophotographic photoreceptor which has high light resistance, has high durability in exposure to oxidizing gases such as ozone and $NO_x$, is excellent in mechanical properties such as printing durability, wearing resistance, marring resistance, and slip properties in repetitions of use, and further has excellent electrical properties. Specifically, the present invention provides an electrophotographic photoreceptor having an electroconductive substrate and provided thereon at least a photosensitive layer having a charge generation material, a charge transport material, and a binder resin.

73 Claims, 1 Drawing Sheet

ELECTROPHOTOGRAPHIC PHOTORECEPTOR, DRUM CARTRIDGE EMPLOYING THE ELECTROPHOTOGRAPHIC PHOTORECEPTOR, AND IMAGE-FORMING APPARATUS

CROSS-REFERENCE TO RELATED APPLICATIONS

The present application claims priority to International Application No. PCT/JP03/15967, filed on Dec. 12, 2003, which claims priority to Japanese Application No. JP2002-362325, filed on Dec. 13, 2002, each of which are hereby incorporated by reference in their entirety.

BACKGROUND OF THE INVENTION

1. Field of the Invention

The present invention provides an electrophotographic photoreceptor. More particularly, the present invention provides a high-performance electrophotographic photoreceptor having excellent light and ozone resistance.

2. Discussion of the Background

Owing to its instantaneous nature and ability to provide high-quality images, electrophotography is used extensively not only in copiers, which are a conventional application, but also in various printers, facsimile telegraphs, and the like.

Inorganic photoconductive materials, such as amorphous silicon and arsenic-selenium systems, are presently employed as part of the photoreceptors, which are the nucleus of electrophotography. However, use of organic photoreceptors remains in the majority.

Multi-layer arrangements have been developed for organic photoreceptors. However, an arrangement in which the multi-layered photosensitive layer consists of a charge generation layer and a charge transport layer, so that the function of charge generation and that of charge transport are separately allotted, is currently being enthusiastically investigated/developed. This is because this type of photosensitive layer has a high degree of freedom of design and, hence, would enable a higher-performance photoreceptor to be produced, as well as having a high productivity, etc. At present, the range of uses thereof has spread even to medium- to high-speed copiers and printers.

The properties required of photoreceptors include the following basic properties: to have high photosensitivity; to have sufficient charge acceptance capacity; to be reduced in dark decay after mechanical light irradiation; to show a low residual potential; to show satisfactory response characteristics; and to be highly stable in these properties in repetitions of use. In addition to the foregoing, various properties are required from the standpoint of practical use.

One of these is ambient light resistance. Usually, the photoreceptor mounted in a copier or laser printer is used in the state of being shielded from ambient light. However, during machine assembly or when the photoreceptor is taken out of the machine due to, e.g., paper sticking, the photoreceptor is inevitably exposed to the ambient light. This ambient light has a far higher intensity than the exposure/mechanical light to be used for image formation in the machine and, hence, causes considerable damage to the photoreceptor. This is because a large amount of charge traps generate within the photoreceptor when the photoreceptor is exposed to light, and in many cases this leads to a considerable increase in residual potential.

Although the mechanism by which charge traps generate has not been fully elucidated, the following hypothesis exists. For example, the charge transport material itself absorbs the exposure/mechanical light and is thus excited. When this charge transport material relaxes from the excited state, it does not return to the original ground state but changes into another structure having an intermediate energy state, and this is causative of the charge traps. In another case, an ingredient in the charge transport layer (e.g., the charge transport material alone or, in the case where substance having an electron affinity is contained, a weak charge-transfer complex formed from the substance having an electron affinity and the charge transport material) is directly excited to generate charge carrier pairs, which result in the charge traps.

On the other hand, various charging techniques are employed in copiers and laser printers. It is known that around the high-voltage charging units, oxygen molecules contained in the air are ionized to generate ozone. It is also known that the ozone thus generated causes damage to the photoreceptor. Although the mechanism of this phenomenon also has not been fully elucidated, it is thought that the deterioration of the photosensitive material by ozone, which is an oxidizing substance, and the resultant charge traps are causative.

Heretofore, techniques used to prevent damage to the photoreceptor include the following. For diminishing the influence of ambient light, use has been made, for example, of a method in which a yellow lamp, which is less influential, is employed as an illuminator in machine assembly and a method in which when the machine is opened, a light-shielding plate is disposed in order to minimize the influence of exposure to ambient light on the photoreceptor. For diminishing the influence of ozone, a method in which a contact type charging device, which is less apt to generate ozone, has been employed, as well as a method in which a fan is employed to discharge the ozone generated outside the apparatus.

On the other hand, materials thought to be unsusceptible to oxidation are being investigated for use, such as the incorporation of an electron-attracting substance or an antioxidant into a charge transport layer as described in, e.g., JP-A-7-191476 and JP-A-5-323631. However, these techniques have been insufficient for preventing an increase in residual potential and the effect of inhibiting a decrease in electrification characteristics.

In particular, there have been problems, for example, that use of an antioxidant alone is ineffective in inhibiting the influence of exposure to ambient light and produces higher side effects on other electrophotographic properties. As such, there remains a critical need for high-performance electrophotographic photoreceptors that have excellent light and ozone resistance.

SUMMARY OF THE INVENTION

There have been cases where when a polyarylate resin is selected as a binder resin for a photosensitive layer, this resin has poor resistance to intense light, ozone, $NO_x$, etc. and sufficient effects are not obtained with various additives which have been known as additives suitable for electrophotographic photoreceptors. Thus, the present invention provides an electrophotographic photoreceptor which has a photosensitive layer employing a polyarylate resin and which has excellent light resistance and excellent durability in exposure to oxidizing gases such as ozone and $NO_x$ and is excellent also in electrical properties and mechanical properties.

The present inventors made intensive investigations on methods for improving light resistance and ozone resistance. As a result, it was discovered that light resistance and ozone resistance can be remarkably improved by incorporating, into the photosensitive layer of an electrophotographic photoreceptor and/or a layer formed on the outer side of the layer, a light-absorbing compound which is compatible with that layer and which, when examined after having been dissolved in tetrahydrofuran in such a concentration that the maximum absorbance of the solution in the range of 400–550 nm is in the range of 0.8–1.6, has at least one maximal absorbance value in the range of from 420 nm to 520 nm.

Namely, an essential point of the present invention resides in an electrophotographic photoreceptor comprising an electroconductive substrate and having provided thereon at least a photosensitive layer comprising a charge generation material, a charge transport material, and a binder resin, characterized in that a polyarylate resin is selected as the binder resin and that the photosensitive layer and/or a layer formed on the outer side of the layer contains a light-absorbing compound which is a compound whose absorbance (value for a tetrahydrofuran solution thereof) in the range of from 420 nm to 520 nm has at least one maximal absorbance value and which has compatibility with the layer containing the compound.

The above objects highlight certain aspects of the invention. Additional objects, aspects and embodiments of the invention are found in the following detailed description of the invention.

BRIEF DESCRIPTION OF THE FIGURES

A more complete appreciation of the invention and many of the attendant advantages thereof will be readily obtained as the same becomes better understood by reference to the following Figures in conjunction with the detailed description below.

In FIG. 1, numeral 1 denotes a photoreceptor, 2 a charging device (charging roller), 3 an exposure device, 4 a developing device, 5 a transfer device, 6 a cleaner, 7 a fixing device, 41 a developing chamber, 42 an agitator, 43 a feed roller, 44 a developing roller, 45 a control member, 71 an upper fixing member (fixing roller), 72 a lower fixing member (fixing roller), and 73 a heater. Furthermore, symbols T and P denote a toner and a recording paper, respectively.

DETAILED DESCRIPTION OF THE INVENTION

Figure 1:
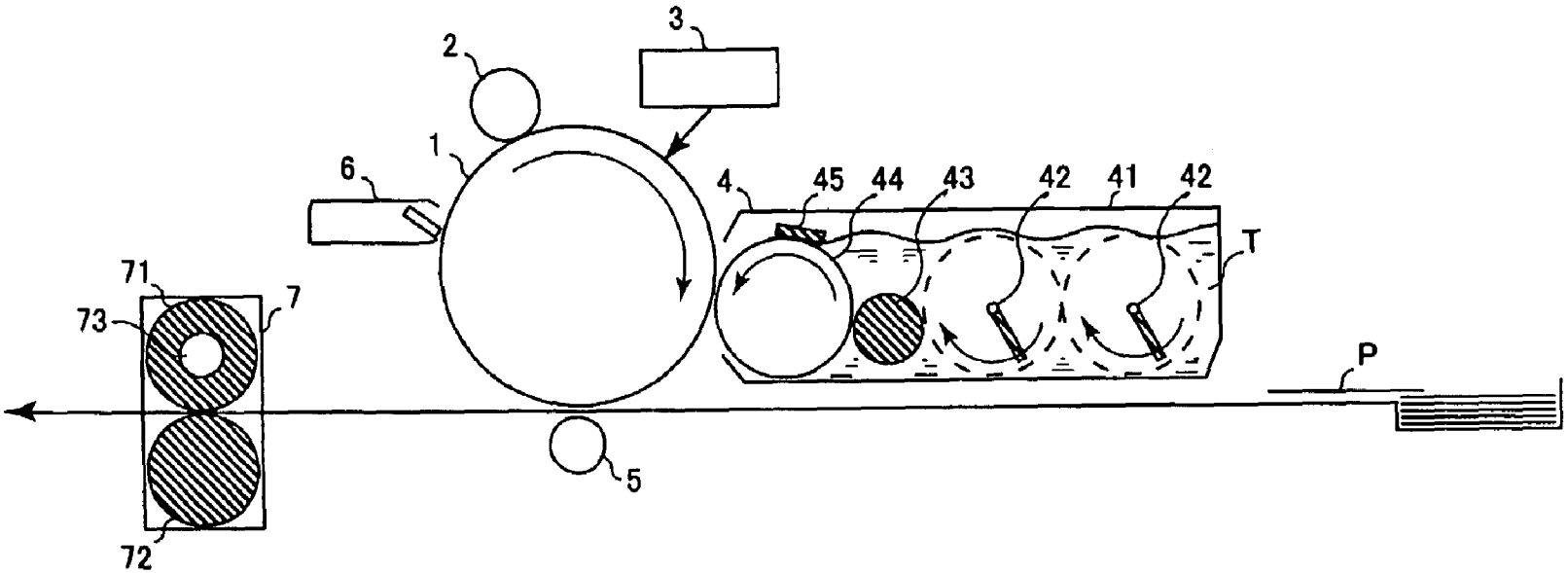
FIG. 1 shows a diagrammatic view illustrating an example of image-forming apparatus employing the electrophotographic photoreceptor of the present invention.

Unless specifically defined, all technical and scientific terms used herein have the same meaning as commonly understood by a skilled artisan in enzymology, biochemistry, cellular biology, molecular biology, and the medical sciences.

All methods and materials similar or equivalent to those described herein can be used in the practice or testing of the present invention, with suitable methods and materials being described herein. All publications, patent applications, patents, and other references mentioned herein are incorporated by reference in their entirety. In case of conflict, the present specification, including definitions, will control. Further, the materials, methods, and examples are illustrative only and are not intended to be limiting, unless otherwise specified.

The electrophotographic photoreceptor of the present invention has a photosensitive layer comprising a charge generation material, a charge transport material, and a binder resin. The photoreceptor employs a polyarylate resin selected from various binder resins usable in electrophotographic photoreceptors. Furthermore, the photosensitive layer of the electrophotographic photoreceptor and/or a layer formed on the outer side of the layer contains a light-absorbing compound which is compatible with the layer containing the compound and which, when examined after having been dissolved in tetrahydrofuran in such a concentration that the maximum absorbance of the solution in the range of 400–550 nm is in the range of 0.8–1.6, has at least one maximal absorbance value in the range of from 420 nm to 520 nm.

An electrophotographic photoreceptor which has excellent light resistance, is excellent also in durability in exposure to oxidizing gases such as ozone and $NO_x$, and is excellent also in electrophotographic properties and mechanical properties can be obtained only when the photosensitive layer is made to have that characteristic constitution.

The electrophotographic photoreceptor of the invention can employ any of the constitutions of electrophotographic photoreceptors which have been known. Namely, the electroconductive substrate may have an undercoat layer, and a photosensitive layer is formed on the electroconductive substrate or on the undercoat layer.

The photosensitive layer can have any of the photosensitive-layer constitutions for electrophotographic photoreceptors which have been known. It may be a multilayered photosensitive layer comprising a charge generation layer containing a charge generation material and a charge transport layer containing a charge transport material, or may be a single-layer photosensitive layer in which a charge generation material and a charge transport material coexist in the same layer. The multilayered photosensitive layer may have two or more charge generation layers or charge transport layers. Furthermore, a known overcoat layer consisting mainly of a thermoplastic or thermoset polymer may be formed as an outermost layer.

The light-absorbing compound in the invention may be contained in any of those layers. Preferably, however, the layer containing a charge transport material or the outermost layer contains the compound. The constitution of the photosensitive layer preferably is a multilayered one, and more preferably is a normal superposition type multilayered photosensitive layer in which a charge generation layer and a charge transport layer have been formed in this order. Especially preferably, the photosensitive layer is one in which the charge transport layer or the overcoat layer contains the compound, and the charge transport layer contains the compound.

Likewise, the polyarylate resin in the invention may be contained in any of the layers constituting the photosensitive layer. Preferably, however, the outermost layer contains the resin. More preferably, the photosensitive layer is a normal superposition type multilayered photosensitive layer in which a charge generation layer and a charge transport layer have been formed in this order and the charge transport layer or the overcoat layer contains a polyarylate resin. Especially preferably, the charge transport layer of the normal superposition type multilayered photosensitive layer contains a polyarylate resin.

Light-Absorbing Compound

The light-absorbing compound in the invention is a compound whose absorbance (value for a tetrahydrofuran solution thereof) in the range of from 420 nm to 520 nm has at least one maximal absorbance value. Specifically, it is a compound which satisfies the following: when the compound is dissolved in tetrahydrofuran in such a concentration that the maximum absorbance of the solution in the range of 400–550 nm is in the range of 0.8–1.6 and this solution is examined for absorption spectrum, then the spectrum has at least one maximal absorbance value in the range of from 420 nm to 520 nm. When ozone resistance is taken into account, the light-absorbing compound preferably is a compound whose absorbance in the range of from 430 nm to 500 nm has at least one maximal absorbance value, and especially preferably is a compound whose absorbance in the range of from 440 nm to 480 nm has at least one maximal absorbance value.

A spectrophotometer for the ultraviolet and visible region is usually used for absorption spectrum examination. In the invention, ultraviolet/visible region spectrophotometer UV-1650PC, manufactured by Shimadzu Corp., was used to make measurements with a solution cell made of quartz (cell dimension in optical-path direction, 10 mm).

Examples of the light-absorbing compound in the present invention include colorant compounds such as dye compounds and pigment compounds.

Specific examples of the colorant compounds include colorant compounds which fall under C.I. Disperse Yellow, C.I. Disperse Orange, C.I. Disperse Red, C.I. Solvent Yellow, C.I. Solvent Orange, C.I. Solvent Red, C.I. Pigment Yellow, C.I. Pigment Orange, and C.I. Pigment Red described in Color Index, and further include azo compounds.

Preferred of those are the colorant compounds falling under C.I. Solvent Orange or C.I. Solvent Red and monoazo compounds represented by the following formula (1).

$$A^1\text{-}N{=}N{-}B^1 \quad (1)$$

In formula (1), $A^1$ and $B^1$ independently represent an aryl group which may have one or more substituents.

It is especially preferred to use a colorant compound falling under C.I. Solvent Orange or a monoazo compound represented by the following formula (2).

$$A^2\text{-}N{=}N{-}B^2 \quad (2)$$

In formula (2), $A^2$ represents an aryl (preferably phenyl) group which may have one or more substituents, and $B^2$ is a group represented by the following formula (3), (4), or (5).

(3)

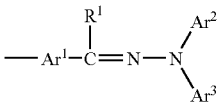

(4)

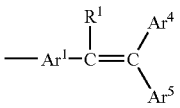

-continued (5)

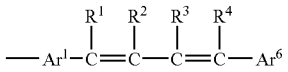

In formulae (3), (4), and (5), $Ar^1$ represents an arylene group (preferably a phenylene group) which may have one or more substituents, and $Ar^2$, $Ar^3$, and $Ar^6$ represent an alkyl group which may have one or more substituents or an aryl group which may have one or more substituents. $Ar^4$, $Ar^5$, and $R^4$ each independently represent a hydrogen atom, an alkyl group which may have one or more substituents, or an aryl group which may have one or more substituents. $R^1$, $R^2$, and $R^3$ represent a hydrogen atom or an alkyl group which may have one or more substituents.

As used in the context of formulae (3), (4), and (5), examples of the alkyl group include methyl, ethyl, propyl, isopropyl, butyl, isobutyl, sec-butyl, and t-butyl; and examples of the aryl group include phenyl, tolyl, xylyl, naphthyl, and pyrenyl.

In formulae (1) and (2), examples of the aryl group include phenyl, tolyl, xylyl, naphthyl, and pyrenyl.

The content of the light-absorbing compound according to the invention in the layer containing the compound is generally 0.1 part by weight or more, preferably 0.2 part by weight or more, and generally 30 parts by weight or less, preferably 20 parts by weight or less, per 100 parts by weight of the binder resin which binds the layer. In case where the content thereof is too small, the effects of the invention are not sufficiently obtained. When the content thereof is too large, there are cases where electrophotographic photoreceptor properties such as, e.g., electrical properties are impaired.

Azo Compound

Examples of the substituents possessed by $A^1$ and $B^1$ in formula (1) include alkoxy groups such as methoxy, ethoxy, and propyloxy; aryloxy groups such as phenoxy and tolyloxy; aralkyloxy groups such as benzyloxy, and phenethyloxy; hydroxy; halogen atoms such as chlorine, bromine, and fluorine atoms; alkyl groups such as methyl, ethyl, propyl, isopropyl, butyl, isobutyl, sec-butyl, and t-butyl; acetyl; dialkylamino groups such as dimethylamino, diethylamino, and diisopropylamino; diarylamino groups such as diphenylamino and di-p-tolylamino; and diarylalkylamino groups such as dibenzylamino.

$Ar^1$ in formulae (3), (4), and (5) is arylene, such as phenylene, tolylene, xylylene, naphthylene, and pyrenylene, each of which may have one or more substituents. Of these, phenylene which may have one or more substituents is preferred. Examples thereof include 1,2-phenylene, 1,3-phenylene, 1,4-phenylene, 2-methyl-1,4-phenylene, 3-methyl-1,4-phenylene, and 2,5-dimethyl-1,4-phenylene.

Preferred of these are substituted or unsubstituted 1,4-phenylene groups such as 1,4-phenylene, 2-methyl-1,4-phenylene, and 2,5-dimethyl-1,4-phenylene.

$Ar^2$, $Ar^3$, and $Ar^6$ in formula (3), (4), and (5) are an alkyl group which may have one or more substituents or an aryl group which may have one or more substituents. Examples thereof include phenyl which may have one or more substituents, such as phenyl, o-tolyl, m-tolyl, p-tolyl, 3,4-dimethylphenyl, or 2,4-dimethylphenyl, biphenyl which may have one or more substituents, naphthyl which may have one or more substituents, such as 1-naphthyl or 2-methyl-1-naphthyl, and phenanthryl which may have one or more substituents.

Preferred of these is phenyl or naphthyl which may have one or more substituents. More preferred is phenyl which may have one or more substituents.

Examples of the alkyl group include linear and branched alkyl groups such as methyl, ethyl, propyl, butyl, isopropyl, and isobutyl.

$Ar^4$, $Ar^5$, and $R^4$ in formulae (3), (4), and (5) are a hydrogen atom, an alkyl group which may have one or more substituents, or an aryl group which may have one or more substituents. $R^1$, $R^2$, and $R^3$ represent a hydrogen atom or an alkyl group which may have one or more substituents. Examples of the alkyl groups include linear and branched alkyl groups such as methyl, ethyl, propyl, butyl, isopropyl, and isobutyl. Examples of the aryl group include phenyl, biphenyl, naphthyl, and phenanthryl. These alkyl and aryl groups may further have substituents, and examples thereof include alkyl groups such as methyl and ethyl; aryl groups such as phenyl, biphenyl, and naphthyl; alkoxy groups such as methoxy, ethoxy, and propyloxy; arlyoxy groups such as phenoxy and tolyloxy; aralkyloxy groups such as benzyloxy, and phenethyloxy; hydroxy; halogen atoms such as chlorine, bromine, and fluorine atoms; alkyl groups such as methyl, ethyl, propyl, isopropyl, butyl, isobutyl, sec-butyl, and t-butyl; acetyl; dialkylamino groups such as dimethylamino, diethylamino, and diisopropylamino; diarylamino groups such as diphenylamino and di-p-tolylamino; and diarylalkylamino groups such as dibenzylamino.

$Ar^4$ and $Ar^5$ preferably are a hydrogen atom or an optionally substituted aryl group, of those examples, and more preferably are a hydrogen atom or an unsubstituted aryl group. Even more preferably, $Ar^4$ and $Ar^5$ are a hydrogen atom or phenyl. In particular, at least one of $Ar^4$ and $Ar^5$ is an aryl group.

Process for Producing Azo Compound

The monoazo compound represented by formula (1) can be synthesized by an ordinary method, for example, a method comprising synthesizing a diazonium salt from a primary amine and subjecting the salt to diazo coupling or the method described in *J. Photopolymer Sci. & Tech.*, Vol. 11, 33(1998).

The monoazo compound represented by formula (2) can be synthesized by an ordinary method, for example, a method comprising synthesizing a diazonium salt from a primary amine and subjecting the salt to diazo coupling to synthesize the target compound or a method in which a precursor ketone or aldehyde compound is subjected to a condensation reaction with a hydrazine compound or to a coupling reaction with a Wittig reagent or Wittig-Horner reagent to synthesize the target compound.

Table 1 given below shows examples of the $A^1$ and $B^1$ groups in the azo compound represented by formula (1). However, the compound in the invention should not be construed as being limited to these.

TABLE 1

| Compound No. | $A^1$ | $B^1$ |
|---|---|---|
| (1)-1 | phenyl | phenyl |
| (1)-2 | phenyl | 4-methoxyphenyl |
| (1)-3 | phenyl | 2-ethoxyphenyl |
| (1)-4 | phenyl | 4-phenoxyphenyl |
| (1)-5 | phenyl | 4-benzyloxyphenyl |
| (1)-6 | phenyl | 2-hydroxphenyl |
| (1)-7 | phenyl | 4-methylphenyl |
| (1)-8 | phenyl | 3-methylphenyl |
| (1)-9 | phenyl | 2-methylphenyl |

TABLE 1-continued

| Compound No. | $A^1$ | $B^1$ |
|---|---|---|
| (1)-10 | phenyl | 4-t-butylphenyl |
| (1)-11 | phenyl | 3-chlorophenyl |
| (1)-12 | phenyl | 3-acetylphenyl |
| (1)-13 | phenyl | 4-diethylaminophenyl |
| (1)-14 | phenyl | 4-diphenylaminophenyl |
| (1)-15 | phenyl | 4-di-p-tolylaminophenyl |
| (1)-16 | phenyl | 4-dibenzylaminophenyl |
| (1)-17 | 4-methoxyphenyl | 4-methoxyphenyl |
| (1)-18 | 4-methoxyphenyl | 4-phenoxyphenyl |
| (1)-19 | 4-methoxyphenyl | 4-benzyloxyphenyl |
| (1)-20 | 4-methoxyphenyl | 2-hydroxyphenyl |
| (1)-21 | 4-methoxyphenyl | 2-methylphenyl |
| (1)-22 | 4-methoxyphenyl | 3-acetylphenyl |
| (1)-23 | 4-methoxyphenyl | 4-diethylaminophenyl |
| (1)-24 | 4-methoxyphenyl | 4-di-p-tolylaminophenyl |
| (1)-25 | 4-methoxyphenyl | 4-dibenzylaminophenyl |
| (1)-26 | 4-phenoxyphenyl | 4-phenoxyphenyl |
| (1)-27 | 4-phenoxyphenyl | 4-benzyloxyphenyl |
| (1)-28 | 4-phenoxyphenyl | 2-hydroxyphenyl |
| (1)-29 | 4-phenoxyphenyl | 2-methylphenyl |
| (1)-30 | 4-phenoxyphenyl | 3-acetylphenyl |
| (1)-31 | 4-phenoxyphenyl | 4-diethylaminophenyl |
| (1)-32 | 4-phenoxyphenyl | 4-di-p-tolylaminophenyl |
| (1)-33 | 4-phenoxyphenyl | 4-dibenzylaminophenyl |
| (1)-34 | 4-benzyloxyphenyl | 4-benzyloxyphenyl |
| (1)-35 | 4-benzyloxyphenyl | 2-hydroxyphenyl |
| (1)-36 | 4-benzyloxyphenyl | 2-methylphenyl |
| (1)-37 | 4-benzyloxyphenyl | 3-acetylphenyl |
| (1)-38 | 4-benzyloxyphenyl | 4-diethylaminophenyl |
| (1)-39 | 4-benzyloxyphenyl | 4-di-p-tolylaminophenyl |
| (1)-40 | 4-benzyloxyphenyl | 4-dibenzylaminophenyl |
| (1)-41 | 2-hydroxyphenyl | 2-hydroxyphenyl |
| (1)-42 | 2-hydroxyphenyl | 2-methylphenyl |
| (1)-43 | 2-hydroxyphenyl | 3-acetylphenyl |
| (1)-44 | 2-hydroxyphenyl | 4-diethylaminophenyl |
| (1)-45 | 2-hydroxyphenyl | 4-di-p-tolylaminophenyl |
| (1)-46 | 2-hydroxyphenyl | 4-dibenzylaminophenyl |
| (1)-47 | 2-methylphenyl | 2-methylphenyl |
| (1)-48 | 2-methylphenyl | 3-acetylphenyl |
| (1)-49 | 2-methylphenyl | 4-dimethylaminophenyl |
| (1)-50 | 2-methylphenyl | 4-di-p-tolylaminophenyl |
| (1)-51 | 2-methylphenyl | 4-dibenzylaminophenyl |
| (1)-52 | 3-acetylphenyl | 3-acetylphenyl |
| (1)-53 | 3-acetylphenyl | 4-diethylaminophenyl |
| (1)-54 | 3-acetylphenyl | 4-di-p-tolylaminophenyl |
| (1)-55 | 3-acetylphenyl | 4-dibenzylaminophenyl |
| (1)-56 | 4-diethylaminophenyl | 4-diethylaminophenyl |
| (1)-57 | 4-diethylaminophenyl | 4-di-p-tolylaminophenyl |
| (1)-58 | 4-diethylaminophenyl | 4-dibenzylaminophenyl |
| (1)-59 | 4-di-p-tolylaminophenyl | 4-di-p-tolylaminophenyl |
| (1)-60 | 4-di-p-tolylaminophenyl | 4-dibenzylaminophenyl |
| (1)-61 | 4-dibenzylaminophenyl | 4-dibenzylaminophenyl |
| (1)-62 | phenyl | 1-naphthyl |
| (1)-63 | phenyl | 2-hydroxy-1-naphthyl |
| (1)-64 | 2-methylphenyl | 2-hydroxy-1-naphthyl |
| (1)-65 | 2,4-dimethylphenyl | 2-hydroxy-1-naphthyl |
| (1)-66 | 1-naphthyl | 1-naphthyl |

Table 2 given below shows examples of the compound represented by formula (2) wherein $B^2$ is represented by formula (3). However, the invention should not be construed as being limited to these examples.

TABLE 2

Compounds represented by formulae (2) and (3)

| Compound No. | $A^2$ | $Ar^1$ | $R^1$ | $Ar^2$ | $Ar^3$ |
|---|---|---|---|---|---|
| (3)-1 | phenyl | 1,4-phenylene | H | phenyl | phenyl |
| (3)-2 | phenyl | 1,4-phenylene | methyl | phenyl | phenyl |
| (3)-3 | phenyl | 1,4-phenylene | H | phenyl | 1-naphthyl |
| (3)-4 | p-methylphenyl | 1,4-phenylene | H | phenyl | phenyl |
| (3)-5 | p-methylphenyl | 1,4-phenylene | methyl | phenyl | phenyl |
| (3)-6 | p-methylphenyl | 1,4-phenylene | H | phenyl | 1-naphthyl |
| (3)-7 | p-methoxyphenyl | 1,4-phenylene | H | phenyl | phenyl |
| (3)-8 | p-methoxyphenyl | 1,4-phenylene | methyl | phenyl | phenyl |
| (3)-9 | p-methoxyphenyl | 1,4-phenylene | H | phenyl | 1-naphthyl |
| (3)-10 | p-diethylaminophenyl | 1,4-phenylene | H | phenyl | phenyl |
| (3)-11 | p-diethylaminophenyl | 1,4-phenylene | methyl | phenyl | phenyl |
| (3)-12 | p-diethylaminophenyl | 1,4-phenylene | H | phenyl | 1-naphthyl |
| (3)-13 | p-diethylamino-o-methylphenyl | 1,4-phenylene | H | phenyl | phenyl |
| (3)-14 | p-diethylamino-o-methylphenyl | 1,4-phenylene | methyl | phenyl | phenyl |
| (3)-15 | p-diethylamino-o-methylphenyl | 1,4-phenylene | H | phenyl | 1-naphthyl |
| (3)-16 | p-di(n-propyl)amino-o-methylphenyl | 1,4-phenylene | H | phenyl | phenyl |
| (3)-17 | p-di(n-propyl)amino-o-methylphenyl | 1,4-phenylene | methyl | phenyl | phenyl |
| (3)-18 | p-di(n-propyl)amino-o-methylphenyl | 1,4-phenylene | H | phenyl | 1-naphthyl |
| (3)-19 | p-di(n-butyl)aminophenyl | 1,4-phenylene | H | phenyl | phenyl |
| (3)-20 | p-di(n-butyl)aminophenyl | 1,4-phenylene | methyl | phenyl | phenyl |
| (3)-21 | p-di(n-butyl)aminophenyl | 1,4-phenylene | H | phenyl | 1-naphthyl |
| (3)-22 | p-di(n-butyl)amino-o-methylphenyl | 1,4-phenylene | H | phenyl | phenyl |
| (3)-23 | p-di(n-butyl)amino-o-methylphenyl | 1,4-phenylene | methyl | phenyl | phenyl |
| (3)-24 | p-di(n-butyl)amino-o-methylphenyl | 1,4-phenylene | H | phenyl | 1-naphthyl |
| (3)-25 | p-diphenylaminophenyl | 1,4-phenylene | H | phenyl | phenyl |
| (3)-26 | p-diphenylaminophenyl | 1,4-phenylene | methyl | phenyl | phenyl |
| (3)-27 | p-diphenylaminophenyl | 1,4-phenylene | H | phenyl | 1-naphthyl |
| (3)-28 | p-di(p-tolyl)aminophenyl | 1,4-phenylene | H | phenyl | phenyl |
| (3)-29 | p-di(p-tolyl)aminophenyl | 1,4-phenylene | methyl | phenyl | phenyl |
| (3)-30 | p-di(p-tolyl)aminophenyl | 1,4-phenylene | H | phenyl | 1-naphthyl |
| (3)-31 | p-di(p-tolyl)amino-o-methylphenyl | 1,4-phenylene | H | phenyl | phenyl |
| (3)-32 | p-di(p-tolyl)amino-o-methylphenyl | 1,4-phenylene | methyl | phenyl | phenyl |
| (3)-33 | p-di(p-tolyl)amino-o-methylphenyl | 1,4-phenylene | H | phenyl | 1-naphthyl |
| (3)-34 | p-chlorophenyl | 1,4-phenylene | H | phenyl | phenyl |
| (3)-35 | p-chlorophenyl | 1,4-phenylene | methyl | phenyl | phenyl |
| (3)-36 | p-chlorophenyl | 1,4-phenylene | H | phenyl | 1-naphthyl |
| (3)-37 | p-nitrophenyl | 1,4-phenylene | H | phenyl | phenyl |
| (3)-38 | p-nitrophenyl | 1,4-phenylene | methyl | phenyl | phenyl |
| (3)-39 | p-nitrophenyl | 1,4-phenylene | H | phenyl | 1-naphthyl |
| (3)-40 | p-phenoxyphenyl | 1,4-phenylene | H | phenyl | phenyl |
| (3)-41 | p-phenoxyphenyl | 1,4-phenylene | methyl | phenyl | phenyl |
| (3)-42 | p-phenoxyphenyl | 1,4-phenylene | H | phenyl | 1-naphthyl |
| (3)-43 | p-acetylphenyl | 1,4-phenylene | H | phenyl | phenyl |
| (3)-44 | p-acetylphenyl | 1,4-phenylene | methyl | phenyl | phenyl |
| (3)-45 | p-acetylphenyl | 1,4-phenylene | H | phenyl | 2-naphthyl |
| (3)-46 | phenyl | 2-methyl-1,4-phenylene | H | phenyl | phenyl |
| (3)-47 | phenyl | 2-methyl-1,4-phenylene | methyl | phenyl | phenyl |
| (3)-48 | phenyl | 2-methyl-1,4-phenylene | H | phenyl | 2-naphthyl |
| (3)-49 | p-methylphenyl | 2-methyl-1,4-phenylene | H | phenyl | phenyl |
| (3)-50 | p-methylphenyl | 2-methyl-1,4-phenylene | methyl | phenyl | phenyl |
| (3)-51 | p-methylphenyl | 2-methyl-1,4-phenylene | H | phenyl | 1-naphthyl |
| (3)-52 | p-methoxyphenyl | 2-methyl-1,4-phenylene | H | phenyl | phenyl |
| (3)-53 | p-methoxyphenyl | 2-methyl-1,4-phenylene | methyl | phenyl | phenyl |
| (3)-54 | p-methoxyphenyl | 2-methyl-1,4-phenylene | H | phenyl | 1-naphthyl |
| (3)-55 | p-diethylaminophenyl | 2-methyl-1,4-phenylene | H | phenyl | phenyl |
| (3)-56 | p-diethylaminophenyl | 2-methyl-1,4-phenylene | methyl | phenyl | phenyl |
| (3)-57 | p-diethylaminophenyl | 2-methyl-1,4-phenylene | H | phenyl | 1-naphthyl |
| (3)-58 | p-diphenylaminophenyl | 2-methyl-1,4-phenylene | H | phenyl | phenyl |
| (3)-59 | p-diphenylaminophenyl | 2-methyl-1,4-phenylene | methyl | phenyl | phenyl |
| (3)-60 | p-diphenylaminophenyl | 2-methyl-1,4-phenylene | H | phenyl | 1-naphthyl |
| (3)-61 | p-di(p-tolyl)aminophenyl | 2-methyl-1,4-phenylene | H | phenyl | phenyl |
| (3)-62 | p-di(p-tolyl)aminophenyl | 2-methyl-1,4-phenylene | methyl | phenyl | phenyl |
| (3)-63 | p-di(p-tolyl)aminophenyl | 2-methyl-1,4-phenylene | H | phenyl | 1-naphthyl |
| (3)-64 | p-di(p-tolyl)amino-o-methylphenyl | 2-methyl-1,4-phenylene | H | phenyl | phenyl |
| (3)-65 | p-di(p-tolyl)amino-o-methylphenyl | 2-methyl-1,4-phenylene | methyl | phenyl | phenyl |
| (3)-66 | p-di(p-tolyl)amino-o-methylphenyl | 2-methyl-1,4-phenylene | H | phenyl | 1-naphthyl |
| (3)-67 | p-chlorophenyl | 2-methyl-1,4-phenylene | H | phenyl | phenyl |
| (3)-68 | p-chlorophenyl | 2-methyl-1,4-phenylene | methyl | phenyl | phenyl |
| (3)-69 | p-chlorophenyl | 2-methyl-1,4-phenylene | H | phenyl | 1-naphthyl |
| (3)-70 | p-nitrophenyl | 2-methyl-1,4-phenylene | H | phenyl | phenyl |
| (3)-71 | p-nitrophenyl | 2-methyl-1,4-phenylene | methyl | phenyl | phenyl |
| (3)-72 | p-nitrophenyl | 2-methyl-1,4-phenylene | H | phenyl | 1-naphthyl |
| (3)-73 | p-phenoxyphenyl | 2-methyl-1,4-phenylene | H | phenyl | phenyl |
| (3)-74 | p-phenoxyphenyl | 2-methyl-1,4-phenylene | methyl | phenyl | phenyl |

TABLE 2-continued

Compounds represented by formulae (2) and (3)

| Compound No. | $A^2$ | $Ar^1$ | $R^1$ | $Ar^2$ | $Ar^3$ |
|---|---|---|---|---|---|
| (3)-75 | p-phenoxyphenyl | 2-methyl-1,4-phenylene | H | phenyl | 1-naphthyl |
| (3)-76 | p-acetylphenyl | 2-methyl-1,4-phenylene | H | phenyl | phenyl |
| (3)-77 | p-acetylphenyl | 2-methyl-1,4-phenylene | methyl | phenyl | phenyl |
| (3)-78 | p-acetylphenyl | 2-methyl-1,4-phenylene | H | phenyl | 1-naphthyl |
| (3)-79 | phenyl | 3-methyl-1,4-phenylene | H | phenyl | phenyl |
| (3)-80 | phenyl | 3-methyl-1,4-phenylene | methyl | phenyl | phenyl |
| (3)-81 | phenyl | 3-methyl-1,4-phenylene | H | phenyl | 1-naphthyl |
| (3)-82 | p-methylphenyl | 3-methyl-1,4-phenylene | H | phenyl | phenyl |
| (3)-83 | p-methylphenyl | 3-methyl-1,4-phenylene | methyl | phenyl | phenyl |
| (3)-84 | p-methylphenyl | 3-methyl-1,4-phenylene | H | phenyl | 1-naphthyl |
| (3)-85 | p-methoxyphenyl | 3-methyl-1,4-phenylene | H | phenyl | phenyl |
| (3)-86 | p-methoxyphenyl | 3-methyl-1,4-phenylene | methyl | phenyl | phenyl |
| (3)-87 | p-methoxyphenyl | 3-methyl-1,4-phenylene | H | phenyl | 1-naphthyl |
| (3)-88 | p-diethylaminophenyl | 3-methyl-1,4-phenylene | H | phenyl | phenyl |
| (3)-89 | p-diethylaminophenyl | 3-methyl-1,4-phenylene | methyl | phenyl | phenyl |
| (3)-90 | p-diethylaminophenyl | 3-methyl-1,4-phenylene | H | phenyl | 1-naphthyl |
| (3)-91 | p-diphenylaminophenyl | 3-methyl-1,4-phenylene | H | phenyl | phenyl |
| (3)-92 | p-diphenylaminophenyl | 3-methyl-1,4-phenylene | methyl | phenyl | phenyl |
| (3)-93 | p-diphenylaminophenyl | 3-methyl-1,4-phenylene | H | phenyl | 1-naphthyl |
| (3)-94 | p-di(p-tolyl)aminophenyl | 3-methyl-1,4-phenylene | H | phenyl | phenyl |
| (3)-95 | p-di(p-tolyl)aminophenyl | 3-methyl-1,4-phenylene | methyl | phenyl | phenyl |
| (3)-96 | p-di(p-tolyl)aminophenyl | 3-methyl-1,4-phenylene | H | phenyl | 1-naphthyl |
| (3)-97 | p-di(p-tolyl)amino-o-methylphenyl | 3-methyl-1,4-phenylene | H | phenyl | phenyl |
| (3)-98 | p-di(p-tolyl)amino-o-methylphenyl | 3-methyl-1,4-phenylene | methyl | phenyl | phenyl |
| (3)-99 | p-di(p-tolyl)amino-o-methylphenyl | 3-methyl-1,4-phenylene | H | phenyl | 1-naphthyl |
| (3)-100 | p-chlorophenyl | 3-methyl-1,4-phenylene | H | phenyl | phenyl |
| (3)-101 | p-chlorophenyl | 3-methyl-1,4-phenylene | methyl | phenyl | phenyl |
| (3)-102 | p-chlorophenyl | 3-methyl-1,4-phenylene | H | phenyl | phenyl |
| (3)-103 | p-nitrophenyl | 3-methyl-1,4-phenylene | methyl | phenyl | phenyl |
| (3)-104 | p-nitrophenyl | 3-methyl-1,4-phenylene | H | phenyl | 1-naphthyl |
| (3)-105 | p-nitrophenyl | 3-methyl-1,4-phenylene | H | phenyl | phenyl |
| (3)-106 | p-phenoxyphenyl | 3-methyl-1,4-phenylene | H | phenyl | phenyl |
| (3)-107 | p-phenoxyphenyl | 3-methyl-1,4-phenylene | methyl | phenyl | phenyl |
| (3)-108 | p-acetylphenyl | 3-methyl-1,4-phenylene | H | phenyl | phenyl |
| (3)-109 | p-acetylphenyl | 3-methyl-1,4-phenylene | methyl | phenyl | phenyl |
| (3)-110 | p-acetylphenyl | 3-methyl-1,4-phenylene | H | phenyl | 1-naphthyl |
| (3)-111 | p-diethylaminophenyl | 1,4-phenylene | methyl | m-tolyl | m-tolyl |
| (3)-112 | p-diethylaminophenyl | 1,4-phenylene | methyl | m-tolyl | phenyl |
| (3)-113 | p-phenoxyphenyl | 3-methyl-1,4-phenylene | H | phenyl | 1-naphthyl |

Table 3 given below shows examples of the compound represented by formula (2) wherein $B^2$ is represented by formula (4). However, the invention should not be construed as being limited to these examples.

TABLE 3

Compounds represented by general formulae (2) and (4)

| Compound No. | $A^2$ | $Ar^1$ | $R^1$ | $Ar^4$ | $Ar^5$ |
|---|---|---|---|---|---|
| (4)-1 | phenyl | 1,4-phenylene | H | H | phenyl |
| (4)-2 | phenyl | 1,4-phenylene | H | phenyl | phenyl |
| (4)-3 | phenyl | 1,4-phenylene | methyl | phenyl | phenyl |
| (4)-4 | phenyl | 1,4-phenylene | H | phenyl | 1-naphthyl |
| (4)-5 | p-methylphenyl | 1,4-phenylene | H | H | phenyl |
| (4)-6 | p-methylphenyl | 1,4-phenylene | H | phenyl | phenyl |
| (4)-7 | p-methylphenyl | 1,4-phenylene | methyl | phenyl | phenyl |
| (4)-8 | p-methylphenyl | 1,4-phenylene | H | phenyl | 1-naphthyl |
| (4)-9 | p-methoxyphenyl | 1,4-phenylene | H | H | phenyl |
| (4)-10 | p-methoxyphenyl | 1,4-phenylene | H | phenyl | phenyl |
| (4)-11 | p-methoxyphenyl | 1,4-phenylene | methyl | phenyl | phenyl |
| (4)-12 | p-methoxyphenyl | 1,4-phenylene | H | phenyl | 1-naphthyl |
| (4)-13 | p-diethylaminophenyl | 1,4-phenylene | H | H | m-tolyl |
| (4)-14 | p-diethylaminophenyl | 1,4-phenylene | H | phenyl | phenyl |
| (4)-15 | p-diethylaminophenyl | 1,4-phenylene | methyl | phenyl | phenyl |
| (4)-16 | p-diethylaminophenyl | 1,4-phenylene | H | phenyl | 1-naphthyl |
| (4)-17 | p-diethylamino-o-methylphenyl | 1,4-phenylene | H | H | m-tolyl |
| (4)-18 | p-diethylamino-o-methylphenyl | 1,4-phenylene | H | phenyl | phenyl |
| (4)-19 | p-diethylamino-o-methylphenyl | 1,4-phenylene | methyl | phenyl | phenyl |
| (4)-20 | p-diethylamino-o-methylphenyl | 1,4-phenylene | H | phenyl | 1-naphthyl |

TABLE 3-continued

Compounds represented by general formulae (2) and (4)

| Compound No. | $A^2$ | $Ar^1$ | $R^1$ | $Ar^4$ | $Ar^5$ |
|---|---|---|---|---|---|
| (4)-21 | p-di(n-propyl)aminophenyl | 1,4-phenylene | H | H | phenyl |
| (4)-22 | p-di(n-propyl)aminophenyl | 1,4-phenylene | H | phenyl | phenyl |
| (4)-23 | p-di(n-propyl)aminophenyl | 1,4-phenylene | methyl | phenyl | phenyl |
| (4)-24 | p-di(n-propyl)aminophenyl | 1,4-phenylene | H | phenyl | 1-naphthyl |
| (4)-25 | p-di(n-butyl)aminophenyl | 1,4-phenylene | H | H | phenyl |
| (4)-26 | p-di(n-butyl)aminophenyl | 1,4-phenylene | H | phenyl | phenyl |
| (4)-27 | p-di(n-butyl)aminophenyl | 1,4-phenylene | methyl | phenyl | phenyl |
| (4)-28 | p-di(n-butyl)aminophenyl | 1,4-phenylene | H | phenyl | 1-naphthyl |
| (4)-29 | p-di(n-butyl)amino-o-methylphenyl | 1,4-phenylene | H | H | phenyl |
| (4)-30 | p-di(n-butyl)amino-o-methylphenyl | 1,4-phenylene | H | phenyl | phenyl |
| (4)-31 | p-di(n-butyl)amino-o-methylphenyl | 1,4-phenylene | methyl | phenyl | phenyl |
| (4)-32 | p-di(n-butyl)amino-o-methylphenyl | 1,4-phenylene | H | phenyl | 1-naphthyl |
| (4)-33 | p-diphenylaminophenyl | 1,4-phenylene | H | H | phenyl |
| (4)-34 | p-diphenylaminophenyl | 1,4-phenylene | H | phenyl | phenyl |
| (4)-35 | p-diphenylaminophenyl | 1,4-phenylene | methyl | phenyl | phenyl |
| (4)-36 | p-diphenylaminophenyl | 1,4-phenylene | H | phenyl | 1-naphthyl |
| (4)-37 | p-di(p-tolyl)aminophenyl | 1,4-phenylene | H | H | phenyl |
| (4)-38 | p-di(p-tolyl)aminophenyl | 1,4-phenylene | H | phenyl | phenyl |
| (4)-39 | p-di(p-tolyl)aminophenyl | 1,4-phenylene | methyl | phenyl | phenyl |
| (4)-40 | p-di(p-tolyl)aminophenyl | 1,4-phenylene | H | phenyl | 1-naphthyl |
| (4)-41 | p-di(p-tolyl)amino-o-methylphenyl | 1,4-phenylene | H | H | phenyl |
| (4)-42 | p-di(p-tolyl)amino-o-methylphenyl | 1,4-phenylene | H | phenyl | phenyl |
| (4)-43 | p-di(p-tolyl)amino-o-methylphenyl | 1,4-phenylene | methyl | phenyl | phenyl |
| (4)-44 | p-di(p-tolyl)amino-o-methylphenyl | 1,4-phenylene | H | phenyl | 1-naphthyl |
| (4)-45 | p-chlorophenyl | 1,4-phenylene | H | H | phenyl |
| (4)-46 | p-chlorophenyl | 1,4-phenylene | H | phenyl | phenyl |
| (4)-47 | p-chlorophenyl | 1,4-phenylene | H | phenyl | 2-naphthyl |
| (4)-48 | p-nitrophenyl | 1,4-phenylene | H | H | phenyl |
| (4)-49 | p-nitrophenyl | 1,4-phenylene | H | phenyl | phenyl |
| (4)-50 | p-nitrophenyl | 1,4-phenylene | methyl | phenyl | phenyl |
| (4)-51 | p-nitrophenyl | 1,4-phenylene | H | phenyl | 2-naphthyl |
| (4)-52 | p-phenoxyphenyl | 1,4-phenylene | H | H | phenyl |
| (4)-53 | p-phenoxyphenyl | 1,4-phenylene | H | phenyl | phenyl |
| (4)-54 | p-phenoxyphenyl | 1,4-phenylene | methyl | phenyl | phenyl |
| (4)-55 | p-phenoxyphenyl | 1,4-phenylene | H | phenyl | 1-naphthyl |
| (4)-56 | p-acetylphenyl | 1,4-phenylene | H | H | phenyl |
| (4)-57 | p-acetylphenyl | 1,4-phenylene | H | phenyl | phenyl |
| (4)-58 | p-acetylphenyl | 1,4-phenylene | methyl | phenyl | phenyl |
| (4)-59 | p-acetylphenyl | 1,4-phenylene | H | phenyl | 1-naphthyl |
| (4)-60 | phenyl | 2-methyl-1,4-phenylene | H | H | phenyl |
| (4)-61 | phenyl | 2-methyl-1,4-phenylene | H | phenyl | phenyl |
| (4)-62 | phenyl | 2-methyl-1,4-phenylene | methyl | phenyl | phenyl |
| (4)-63 | phenyl | 2-methyl-1,4-phenylene | H | phenyl | 1-naphthyl |
| (4)-64 | p-methylphenyl | 2-methyl-1,4-phenylene | H | H | phenyl |
| (4)-65 | p-methylphenyl | 2-methyl-1,4-phenylene | H | phenyl | phenyl |
| (4)-66 | p-methylphenyl | 2-methyl-1,4-phenylene | methyl | phenyl | phenyl |
| (4)-67 | p-methylphenyl | 2-methyl-1,4-phenylene | H | phenyl | 1-naphthyl |
| (4)-68 | p-methoxyphenyl | 2-methyl-1,4-phenylene | H | H | phenyl |
| (4)-69 | p-methoxyphenyl | 2-methyl-1,4-phenylene | H | phenyl | phenyl |
| (4)-70 | p-methoxyphenyl | 2-methyl-1,4-phenylene | methyl | phenyl | phenyl |
| (4)-71 | p-methoxyphenyl | 2-methyl-1,4-phenylene | H | phenyl | 1-naphthyl |
| (4)-72 | p-diethylaminophenyl | 2-methyl-1,4-phenylene | H | H | phenyl |
| (4)-73 | p-diethylaminophenyl | 2-methyl-1,4-phenylene | H | phenyl | phenyl |
| (4)-74 | p-diethylaminophenyl | 2-methyl-1,4-phenylene | methyl | phenyl | phenyl |
| (4)-75 | p-diethylaminophenyl | 2-methyl-1,4-phenylene | H | phenyl | 1-naphthyl |
| (4)-76 | p-diphenylaminophenyl | 2-methyl-1,4-phenylene | H | H | phenyl |
| (4)-77 | p-diphenylaminophenyl | 2-methyl-1,4-phenylene | H | phenyl | phenyl |
| (4)-78 | p-diphenylaminophenyl | 2-methyl-1,4-phenylene | methyl | phenyl | phenyl |
| (4)-79 | p-diphenylaminophenyl | 2-methyl-1,4-phenylene | H | phenyl | 1-naphthyl |
| (4)-80 | p-di(p-tolyl)aminophenyl | 2-methyl-1,4-phenylene | H | H | phenyl |
| (4)-81 | p-di(p-tolyl)aminophenyl | 2-methyl-1,4-phenylene | H | phenyl | phenyl |
| (4)-82 | p-di(p-tolyl)aminophenyl | 2-methyl-1,4-phenylene | methyl | phenyl | phenyl |
| (4)-83 | p-di(p-tolyl)aminophenyl | 2-methyl-1,4-phenylene | H | phenyl | 1-naphthyl |
| (4)-84 | p-di(p-tolyl)amino-o-methylphenyl | 2-methyl-1,4-phenylene | H | H | phenyl |
| (4)-85 | p-di(p-tolyl)amino-o-methylphenyl | 2-methyl-1,4-phenylene | H | phenyl | phenyl |
| (4)-86 | p-di(p-tolyl)amino-o-methylphenyl | 2-methyl-1,4-phenylene | methyl | phenyl | phenyl |
| (4)-87 | p-di(p-tolyl)amino-o-methylphenyl | 2-methyl-1,4-phenylene | H | phenyl | 1-naphthyl |
| (4)-88 | p-chlorophenyl | 2-methyl-1,4-phenylene | H | H | phenyl |
| (4)-89 | p-chlorophenyl | 2-methyl-1,4-phenylene | H | phenyl | phenyl |
| (4)-90 | p-chlorophenyl | 2-methyl-1,4-phenylene | methyl | phenyl | phenyl |
| (4)-91 | p-chlorophenyl | 2-methyl-1,4-phenylene | H | phenyl | 1-naphthyl |
| (4)-92 | p-nitrophenyl | 2-methyl-1,4-phenylene | H | H | phenyl |
| (4)-93 | p-nitrophenyl | 2-methyl-1,4-phenylene | H | phenyl | phenyl |
| (4)-94 | p-nitrophenyl | 2-methyl-1,4-phenylene | methyl | phenyl | phenyl |

TABLE 3-continued

Compounds represented by general formulae (2) and (4)

| Compound No. | $A^2$ | $Ar^1$ | $R^1$ | $Ar^4$ | $Ar^5$ |
|---|---|---|---|---|---|
| (4)-95 | p-nitrophenyl | 2-methyl-1,4-phenylene | H | phenyl | 1-naphthyl |
| (4)-96 | p-phenoxyphenyl | 2-methyl-1,4-phenylene | H | H | phenyl |
| (4)-97 | p-phenoxyphenyl | 2-methyl-1,4-phenylene | H | phenyl | phenyl |
| (4)-98 | p-phenoxyphenyl | 2-methyl-1,4-phenylene | methyl | phenyl | phenyl |
| (4)-99 | p-phenoxyphenyl | 2-methyl-1,4-phenylene | H | phenyl | 1-naphthyl |
| (4)-100 | p-acetylphenyl | 2-methyl-1,4-phenylene | H | H | phenyl |
| (4)-101 | p-acetylphenyl | 2-methyl-1,4-phenylene | H | phenyl | phenyl |
| (4)-102 | p-acetylphenyl | 2-methyl-1,4-phenylene | methyl | phenyl | phenyl |
| (4)-103 | p-acetylphenyl | 2-methyl-1,4-phenylene | H | phenyl | 1-naphthyl |
| (4)-104 | phenyl | 3-methyl-1,4-phenylene | H | H | phenyl |
| (4)-105 | phenyl | 3-methyl-1,4-phenylene | H | phenyl | phenyl |
| (4)-106 | phenyl | 3-methyl-1,4-phenylene | methyl | phenyl | phenyl |
| (4)-107 | phenyl | 3-methyl-1,4-phenylene | H | phenyl | 1-naphthyl |
| (4)-108 | p-methylphenyl | 3-methyl-1,4-phenylene | H | H | phenyl |
| (4)-109 | p-methylphenyl | 3-methyl-1,4-phenylene | H | phenyl | phenyl |
| (4)-110 | p-methylphenyl | 3-methyl-1,4-phenylene | methyl | phenyl | phenyl |
| (4)-111 | p-methylphenyl | 3-methyl-1,4-phenylene | H | phenyl | 1-naphthyl |
| (4)-112 | p-methoxyphenyl | 3-methyl-1,4-phenylene | H | H | phenyl |
| (4)-113 | p-methoxyphenyl | 3-methyl-1,4-phenylene | H | phenyl | phenyl |
| (4)-114 | p-methoxyphenyl | 3-methyl-1,4-phenylene | methyl | phenyl | phenyl |
| (4)-115 | p-methoxyphenyl | 3-methyl-1,4-phenylene | H | phenyl | 1-naphthyl |
| (4)-116 | p-diethylaminophenyl | 3-methyl-1,4-phenylene | H | H | phenyl |
| (4)-117 | p-diethylaminophenyl | 3-methyl-1,4-phenylene | H | phenyl | phenyl |
| (4)-118 | p-diethylaminophenyl | 3-methyl-1,4-phenylene | methyl | phenyl | phenyl |
| (4)-119 | p-diethylaminophenyl | 3-methyl-1,4-phenylene | H | phenyl | 1-naphthyl |
| (4)-120 | p-diphenylaminophenyl | 3-methyl-1,4-phenylene | H | H | phenyl |
| (4)-121 | p-diphenylaminophenyl | 3-methyl-1,4-phenylene | H | phenyl | phenyl |
| (4)-122 | p-diphenylaminophenyl | 3-methyl-1,4-phenylene | methyl | phenyl | phenyl |
| (4)-123 | p-diphenylaminophenyl | 3-methyl-1,4-phenylene | H | phenyl | 1-naphthyl |
| (4)-124 | p-di(p-tolyl)aminophenyl | 3-methyl-1,4-phenylene | H | H | phenyl |
| (4)-125 | p-di(p-tolyl)aminophenyl | 3-methyl-1,4-phenylene | H | phenyl | phenyl |
| (4)-126 | p-di(p-tolyl)aminophenyl | 3-methyl-1,4-phenylene | methyl | phenyl | phenyl |
| (4)-127 | p-di(p-tolyl)aminophenyl | 3-methyl-1,4-phenylene | H | phenyl | 1-naphthyl |
| (4)-128 | p-di(p-tolyl)amino-o-methylphenyl | 3-methyl-1,4-phenylene | H | H | phenyl |
| (4)-129 | p-di(p-tolyl)amino-o-methylphenyl | 3-methyl-1,4-phenylene | H | phenyl | phenyl |
| (4)-130 | p-di(p-tolyl)amino-o-methylphenyl | 3-methyl-1,4-phenylene | methyl | phenyl | phenyl |
| (4)-131 | p-di(p-tolyl)amino-o-methylphenyl | 3-methyl-1,4-phenylene | H | phenyl | 1-naphthyl |
| (4)-132 | p-chlorophenyl | 3-methyl-1,4-phenylene | H | H | phenyl |
| (4)-133 | p-chlorophenyl | 3-methyl-1,4-phenylene | H | phenyl | phenyl |
| (4)-134 | p-chlorophenyl | 3-methyl-1,4-phenylene | methyl | phenyl | phenyl |
| (4)-135 | p-chlorophenyl | 3-methyl-1,4-phenylene | H | phenyl | phenyl |
| (4)-136 | p-nitrophenyl | 3-methyl-1,4-phenylene | H | H | phenyl |
| (4)-137 | p-nitrophenyl | 3-methyl-1,4-phenylene | H | phenyl | phenyl |
| (4)-138 | p-nitrophenyl | 3-methyl-1,4-phenylene | methyl | phenyl | phenyl |
| (4)-139 | p-nitrophenyl | 3-methyl-1,4-phenylene | H | phenyl | 1-naphthyl |
| (4)-140 | p-phenoxyphenyl | 3-methyl-1,4-phenylene | H | H | phenyl |
| (4)-141 | p-phenoxyphenyl | 3-methyl-1,4-phenylene | H | phenyl | phenyl |
| (4)-142 | p-phenoxyphenyl | 3-methyl-1,4-phenylene | H | phenyl | 1-naphthyl |
| (4)-143 | p-acetylphenyl | 3-methyl-1,4-phenylene | H | H | phenyl |
| (4)-144 | p-acetylphenyl | 3-methyl-1,4-phenylene | H | phenyl | phenyl |
| (4)-145 | p-acetylphenyl | 3-methyl-1,4-phenylene | methyl | phenyl | phenyl |
| (4)-146 | p-acetylphenyl | 3-methyl-1,4-phenylene | H | phenyl | 1-naphthyl |
| (4)-147 | p-diethylamino-o-methylphenyl | 1,4-phenylene | phenyl | H | phenyl |
| (4)-148 | p-diethylamino-o-methylphenyl | 1,4-phenylene | H | 3-tolyl | phenyl |
| (4)-149 | p-diethylamino-o-methylphenyl | 1,4-phenylene | methyl | benzyl | phenyl |
| (4)-150 | p-diethylamino-o-methylphenyl | 1,4-phenylene | methyl | phenyl | 3-tolyl |
| (4)-151 | p-diethylaminophenyl | 1,4-phenylene | methyl | benzyl | benzyl |
| (4)-152 | p-diethylaminophenyl | 1,4-phenylene | methyl | 3-tolyl | 3-tolyl |
| (4)-153 | p-chlorophenyl | 1,4-phenylene | methyl | phenyl | phenyl |
| (4)-154 | p-phenoxyphenyl | 3-methyl-1,4-phenylene | methyl | phenyl | phenyl |

Table 4 given below shows examples of the compound represented by formula (2) wherein $B^2$ is represented by formula (5). However, the invention should not be construed as being limited to these examples.

| Compound No. | $A^2$ | $Ar^1$ | $R^1$ | $R^2$ | $R^3$ | $R^4$ | $Ar^6$ |
|---|---|---|---|---|---|---|---|
| (5)-1 | p-diethylamino-o-methylphenyl | phenylene | H | H | H | H | phenyl |
| (5)-2 | p-diethylaminophenyl | phenylene | methyl | H | H | H | phenyl |
| (5)-3 | p-diethylaminophenyl | phenylene | H | H | H | H | phenyl |
| (5)-4 | p-diethylaminophenyl | phenylene | H | H | H | methyl | phenyl |
| (5)-5 | p-diethylaminophenyl | phenylene | H | H | H | phenyl | phenyl |
| (5)-6 | di(n-propyl)aminophenyl | phenylene | H | H | H | H | phenyl |
| (5)-7 | di(n-propyl)aminophenyl | phenylene | methyl | H | H | H | phenyl |
| (5)-8 | di(n-propyl)aminophenyl | phenylene | H | H | H | H | 1-naphthyl |
| (5)-9 | di(n-propyl)aminophenyl | phenylene | H | H | H | methyl | phenyl |
| (5)-10 | di(n-propyl)aminophenyl | phenylene | H | H | H | phenyl | phenyl |
| (5)-11 | p-methoxyphenyl | phenylene | H | H | H | H | phenyl |
| (5)-12 | p-methoxyphenyl | phenylene | methyl | H | H | H | phenyl |
| (5)-13 | p-methoxyphenyl | phenylene | H | H | H | H | 1-naphthyl |
| (5)-14 | p-methoxyphenyl | phenylene | H | H | H | methyl | phenyl |
| (5)-15 | p-methoxyphenyl | phenylene | H | H | H | phenyl | phenyl |
| (5)-16 | p-methylphenyl | phenylene | H | H | H | H | phenyl |
| (5)-17 | p-methylphenyl | phenylene | methyl | H | H | H | phenyl |
| (5)-18 | p-methylphenyl | phenylene | H | H | H | H | 1-naphthyl |
| (5)-19 | p-methylphenyl | phenylene | H | H | H | methyl | phenyl |
| (5)-20 | p-methylphenyl | phenylene | H | H | H | phenyl | phenyl |
| (5)-21 | p-diphenylaminophenyl | phenylene | H | H | H | H | phenyl |
| (5)-22 | p-diphenylaminophenyl | phenylene | methyl | H | H | H | phenyl |
| (5)-23 | p-diphenylaminophenyl | phenylene | H | H | H | H | 1-naphthyl |
| (5)-24 | p-diphenylaminophenyl | phenylene | H | H | H | methyl | phenyl |
| (5)-25 | p-diphenylaminophenyl | phenylene | H | H | H | phenyl | phenyl |
| (5)-26 | p-di(p-tolyl)aminophenyl | phenylene | H | H | H | H | phenyl |
| (5)-27 | p-di(p-tolyl)aminophenyl | phenylene | methyl | H | H | H | phenyl |
| (5)-28 | p-di(p-tolyl)aminophenyl | phenylene | H | H | H | H | 1-naphthyl |
| (5)-29 | p-di(p-tolyl)aminophenyl | phenylene | H | H | H | methyl | phenyl |
| (5)-30 | p-di(p-tolyl)aminophenyl | phenylene | H | H | H | phenyl | phenyl |
| (5)-31 | p-nitrophenyl | phenylene | H | H | H | H | phenyl |
| (5)-32 | p-nitrophenyl | phenylene | methyl | H | H | H | phenyl |
| (5)-33 | p-nitrophenyl | phenylene | H | H | H | H | 2-naphthyl |
| (5)-34 | p-nitrophenyl | phenylene | H | H | H | methyl | phenyl |
| (5)-35 | p-nitrophenyl | phenylene | H | H | H | phenyl | phenyl |
| (5)-36 | p-chlorophenyl | phenylene | H | H | H | H | phenyl |
| (5)-37 | p-chlorophenyl | phenylene | methyl | H | H | H | phenyl |
| (5)-38 | p-chlorophenyl | phenylene | H | H | H | H | 2-naphthyl |
| (5)-39 | p-chlorophenyl | phenylene | H | H | H | methyl | phenyl |
| (5)-40 | p-chlorophenyl | phenylene | H | H | H | phenyl | phenyl |
| (5)-41 | p-acetylphenyl | phenylene | H | H | H | H | phenyl |
| (5)-42 | p-acetylphenyl | phenylene | methyl | H | H | H | phenyl |
| (5)-43 | p-acetylphenyl | phenylene | H | H | H | H | 1-naphthyl |
| (5)-44 | p-acetylphenyl | phenylene | H | H | H | methyl | phenyl |
| (5)-45 | p-acetylphenyl | phenylene | H | H | H | phenyl | phenyl |
| (5)-46 | p-di(p-tolyl)aminophenyl | phenylene | H | H | H | H | m-tolyl |
| (5)-47 | p-di(p-tolyl)aminophenyl | phenylene | methyl | H | H | H | m-tolyl |
| (5)-48 | p-di(p-tolyl)aminophenyl | phenylene | H | H | H | H | p-tolyl |
| (5)-49 | p-di(p-tolyl)aminophenyl | phenylene | H | H | H | methyl | m-tolyl |
| (5)-50 | p-di(p-tolyl)aminophenyl | phenylene | H | H | H | phenyl | p-tolyl |

Polyarylate Resin

The polyarylate resin in the electrophotographic photoreceptor of the invention is used for the purpose of binding the photosensitive layer. This polyarylate resin may be any polyarylate resin usable in electrophotographic photoreceptors. In general, however, it is a resin formed by the bonding of a dihydroxy ingredient having an aromatic ring in the structure to a dicarboxylic acid ingredient having an aromatic ring in the structure through ester linkage.

When the durability of the photosensitive layer, etc. are taken into account, polyarylate resins comprising one or more kinds of repeating units represented by the following formula (6) are especially preferred of such polyarylate resins.

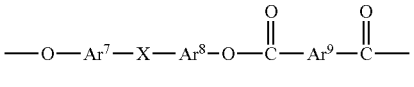

(6)

In the formula, $Ar^7$, $Ar^8$, and $Ar^9$ each independently represents an arylene group which may have one or more substituents, and X represents a direct bond between $Ar^7$ and $Ar^8$ (i.e., X is not present or does not represent an atom) or a divalent connecting group.

$Ar^7$, $Ar^8$, and $Ar^9$ in formula (6) each independently represents an arylene group which may have one or more substituents. Examples of the substituents include alkyl groups which have 1–10 carbon atoms and may have one or more substituents, alkoxy groups which have 1–10 carbon atoms and may have one or more substituents, halogens, halogenoalkyl groups having 1–10 carbon atoms, and aromatic groups which have 6–20 carbon atoms and may have one or more substituents. Preferred of these substituents are alkyl groups which have 1–10 carbon atoms and may have one or more substituents and aromatic groups which have 6–20 carbon atoms and may have one or more substituents.

Although X represents a direct bond or a divalent connecting group, it preferably is a divalent connecting group. Examples of the divalent connecting group include hydrocarbon groups which may have one or more substituents, —O—, —S—, —CO—, and —$SO_2$—. Preferred of these are hydrocarbon groups which may have one or more substituents.

Especially preferred of the hydrocarbon groups which may have one or more substituents are chain-structure alkylene groups which have 1–6 carbon atoms and may have one or more substituents, chain-structure alkylidene groups which have 1–6 carbon atoms and may have one or more substituents, cyclic-structure alkylene groups which have 3–6 carbon atoms and may have one or more substituents, and cyclic-structure alkylidene groups which have 3–6 carbon atoms and may have one or more substituents. The substituents which may be possessed by the chain-structure alkylene groups having 1–6 carbon atoms preferably are aryl groups, especially preferably phenyl.

The structural part represented by —O—$Ar^7$—X—$Ar^8$—O— in formula (6) is one formed from a biphenol ingredient or bisphenol ingredient by removing the hydrogen atoms from the phenolic hydroxy groups. Examples of the structure of the corresponding biphenol ingredient or bisphenol ingredient include the following.

Examples of the biphenol ingredient include 4,4'-biphenol, 2,4'-biphenol, 3,3'-dimethyl-4,4'-dihydroxy-1,1'-biphenyl, 3,3'-dimethyl-2,4'-dihydroxy-1,1'-biphenyl, 3,3'-di(t-butyl)-4,4'-dihydroxy-1,1'-biphenyl, 3,3',5,5'-tetramethyl-4,4'-dihydroxy-1,1'-biphenyl, 3,3',5,5'-tetra(t-butyl)-4,4'-dihydroxy-1,1'-biphenyl, and 2,2',3,3',5,5'-hexamethyl-4,4'-dihydroxy-1,1'-biphenyl.

Examples of the bisphenol ingredient include bis(4-hydroxy-3,5-dimethylphenyl)methane, bis(4-hydroxyphenyl)methane, bis(4-hydroxy-3-methylphenyl)methane, 1,1-bis(4-hydroxyphenyl)ethane, 1,1-bis(4-hydroxyphenyl)propane, 2,2-bis(4-hydroxyphenyl)propane, 2,2-bis(4-hydroxy-3-methylphenyl)propane, 2,2-bis(4-hydroxyphenyl)butane, 2,2-bis(4-hydroxyphenyl)pentane, 2,2-bis(4-hydroxyphenyl)-3-methylbutane, 2,2-bis(4-hydroxyphenyl)hexane, 2,2-bis(4-hydroxyphenyl)-4-methylpentane, 1,1-bis(4-hydroxyphenyl)cyclopentane, 1,1-bis(4-hydroxyphenyl)cyclohexane, bis(3-phenyl-4-hydroxyphenyl)methane, 1,1-bis(3-phenyl-4-hydroxyphenyl)ethane, 1,1-bis(3-phenyl-4-hydroxyphenyl)propane, 2,2-bis(3-phenyl-4-hydroxyphenyl)propane, 1,1-bis(4-hydroxy-3-methylphenyl)ethane, 2,2-bis(4-hydroxy-3-ethylphenyl)propane, 2,2-bis(4-hydroxy-3-isopropylphenyl)propane, 2,2-bis(4-hydroxy-3-sec-butylphenyl)propane, 1,1-bis(4-hydroxy-3,5-dimethylphenyl)ethane, 2,2-bis(4-hydroxy-3,5-dimethylphenyl)propane, 1,1-bis(4-hydroxy-3,6-dimethylphenyl)ethane, bis(4-hydroxy-2,3,5-trimethylphenyl)methane, 1,1-bis(4-hydroxy-2,3,5-trimethylphenyl)ethane, 2,2-bis(4-hydroxy-2,3,5-trimethylphenyl)propane, bis(4-hydroxy-2,3,5-trimethylphenyl)phenylmethane, 1,1-bis(4-hydroxy-2,3,5-trimethylphenyl)phenylethane, 1,1-bis(4-hydroxy-2,3,5-trimethylphenyl)cyclohexane, bis(4-hydroxyphenyl)phenylmethane, 1,1-bis(4-hydroxyphenyl)-1-phenylethane, 1,1-bis(4-hydroxyphenyl)-1-phenylpropane, bis(4-hydroxyphenyl)diphenylmethane, bis(4-hydroxyphenyl)dibenzylmethane, 4,4'-[1,4-phenylenebis(1-methylethylidene)]bis[phenol], 4,4'-[1,4-phenylenebismethylene]bis[phenol], 4,4'-[1,4-phenylenebis(1-methylethylidene)]bis[2,6-dimethylphenol], 4,4'-[1,4-phenylenebismethylene]bis[2,6-dimethylphenol], 4,4'-[1,4-phenylenebismethylene]bis[2,3,6-trimethylphenol], 4,4'-[1,4-phenylenebis(1-methylethylidene)]bis[2,3,6-trimethylphenol], 4,4'-[1,3-phenylenebis(1-methylethylidene)]bis[2,3,6-trimethylphenol], 4,4'-dihydroxydiphenyl ether, 4,4'-dihydroxydiphenyl sulfone, 4,4'-dihydroxydiphenyl sulfide, 3,3',5,5'-tetramethyl-4,4'-dihydroxydiphenyl ether, 3,3',5,5'-tetramethyl-4,4'-dihydroxydiphenyl sulfone, 3,3',5,5'-tetramethyl-4,4'-dihydroxydiphenyl sulfide, phenolphthalein, 4,4'-[1,4-phenylenebis(1-methylvinylidene)]bisphenol, 4,4'-[1,4-phenylenebis(1-methylvinylidene)]bis[2-methylphenol], (2-hydroxyphenyl)(4-hydroxyphenyl)methane, (2-hydroxy-5-methylphenyl)(4-hydroxy-3-methylphenyl)methane, 1,1-(2-hydroxyphenyl)(4-hydroxyphenyl)ethane, 2,2-(2-hydroxyphenyl)(4-hydroxyphenyl)propane, and 1,1-(2-hydroxyphenyl)(4-hydroxyphenyl)propane.

Preferred compounds of these include bis(4-hydroxy-3,5-dimethylphenyl)methane, bis(4-hydroxyphenyl)methane, bis(4-hydroxy-3-methylphenyl)methane, 1,1-bis(4-hydroxy-3-methylphenyl)ethane, 2,2-bis(4-hydroxy-3-methylphenyl)propane, 1,1-bis(4-hydroxyphenyl)ethane, 2,2-bis(4-hydroxyphenyl)propane, 2-hydroxyphenyl(4-hydroxyphenyl)methane, and 2,2-(2-hydroxyphenyl)(4-hydroxyphenyl)propane.

$Ar^9$ in formula (6) represents an arylene group which may have one or more substituents. These arylene groups may be of one kind or two or more kinds. Examples of $Ar^9$ include o-phenylene, m-phenylene, p-phenylene, 4,4'-biphenylene, 1,4-naphthylene, 1,2-naphthylene, and a 4,4'-diphenyl ether group. Preferred of these are m-phenylene, p-phenylene, 4,4'-biphenylene, and a 4,4'-diphenyl ether group. Especially preferred are m-phenylene and p-phenylene. Two or more of these may be used in combination in order to improve solubility.

The viscosity-average molecular weight of the polyarylate resin contained in the photosensitive layer in the invention is generally 10,000 or higher, preferably 15,000 or higher, more preferably 20,000 or higher, and is generally 300,000 or lower, preferably 100,000 or lower, more preferably 50,000 or lower. In case where the viscosity-average molecular weight thereof is lower than 10,000, the resin has reduced mechanical strength and is impractical. In case where the viscosity-average molecular weight thereof exceeds 300,000, it is difficult to conduct coating in an appropriate thickness.

For binding the photosensitive layer in the invention, the polyarylate resin may be used in combination with one or more other resins selected, for example, from vinyl polymers such as poly(methyl methacrylate), polystyrene, and poly(vinyl chloride), copolymers thereof, polycarbonate resins, polyester resins, polyester carbonate resins, polysulfone resins, polyimide resins, phenoxy resins, epoxy resins, silicone resins, and resins obtained by partly crosslinking/curing these resins. Preferred of these resins usable in combination with the polyarylate resin are polycarbonate resins, polyester resins, and polyester carbonate resins. It is especially preferred to use a polycarbonate in combination with the polyarylate resin.

In the case where the polyarylate resin according to the invention is used in combination with one or more other resins, the proportions thereof can be selected at will according to the properties required of the electrophotographic apparatus to which the photoreceptor of the invention is to be applied. When mechanical durability and the like are taken into account, the polyarylate resin according to the invention preferably has the highest proportion among all binder resins. More preferably, the proportion thereof is 50% by weight or higher.

Due to the use of the polyarylate resin in combination with the light-absorbing compound, the electrophotographic photoreceptor of the invention has excellent light resistance, is excellent also in durability in exposure to oxidizing gases such as ozone and $NO_x$, and is further excellent in electrical properties and mechanical properties.

Electroconductive Substrate

The electroconductive substrate to be used in the electrophotographic photoreceptor of the invention is, for example, a metallic material such as aluminum, an aluminum alloy, stainless steel, copper, or nickel, a resinous material to which electrical conductivity has been imparted by adding a conductive powder such as a metal, carbon, or tin oxide, or an insulating substrate, e.g., a polyester film or paper, on a surface of which a conductive layer of aluminum, copper, palladium, tin oxide, indium oxide, or the like has been formed. Such a substrate may be used in the form of a sheet, belt, drum, or roll. The surface of the substrate may be smooth or may have been roughened by a special machining method or by conducting an abrading treatment.

Undercoat Layer

Two or more of various undercoat layers may be formed on the electroconductive substrate according to need so as to be interposed between the substrate and the photosensitive layer.

Known undercoat layers include: a conductive layer which covers defects of the substrate and prevents interference in the case where the exposure light is a coherent light, e.g., a laser light; a barrier layer which regulates electrification characteristics and charge injection from the substrate; and an adhesive layer which improves adhesion between the photosensitive layer and the substrate.

As the conductive layer is used, for example, one comprising a binder resin and, dispersed therein, conductive particles such as carbon black, metal particles, or metal oxide particles. The thickness of the conductive layer is generally 5–40 μm, preferably 10–30 μm.

As the barrier layer can, for example, be used an inorganic layer such as a film formed by aluminum anodization, aluminum oxide, or aluminum hydroxide or an organic layer made of a polyamide resin, polyimide resin, polyester resin, polyurethane resin, polycarbonate resin, epoxy resin, vinyl chloride resin, acrylic resin, phenolic resin, urea resin, melamine resin, guanamine resin, poly(vinyl alcohol), polyvinylpyrrolidone, casein, gelatin, cellulose, or starch. In the case of a film formed by aluminum anodization, it is desirable to conduct a sealing treatment by a known method. Especially preferred of such organic layers is a solvent-soluble polyamide resin.

In the case where an organic layer is used as a barrier layer, the organic layer may be used alone or may be used in such a state that the organic layer contains, dispersed therein, a metal compound such as titania, alumina, silica, zirconium oxide, zinc oxide, or iron oxide or fine particles of a metal such as copper, silver, or aluminum. Preferred of these is the organic layer containing metal compound particles dispersed therein.

The metal compound particles preferably are n-form (electron-transporting) particles. Examples of such metal compounds include titanates such as strontium titanate, calcium titanate, and barium titanate; titanium oxide; solid solutions of a metal oxide, e.g., nickel oxide, zinc oxide, or cobalt oxide, in titanium oxide; and titanium oxides doped with a metal element such as niobium, antimony, tungsten, indium, nickel, iron, or silicon. Preferred of these from the standpoints of cost and compound stability are white titanium oxide particles. From the standpoints of the dispersion stability of the coating fluid for undercoat layer formation and electrical properties including residual potential, those particulate metal compounds preferably are particles having an average primary-particle diameter of generally 100 nm or smaller. The metal compound particles may have undergone a hydrophobizing treatment so as to stabilize a dispersion of the particles.

The thickness of the barrier layer can be selected at will. However, the thickness of the layer to be used is in the range of generally from 0.05 μm to 20 μm, preferably from 0.1 μm to 10 μm.

The volume resistivity of the barrier layer to be used is preferably $1\times10^7$ ohm·cm or higher because too low volume resistivities disadvantageously facilitate charge movement and inhibit the photoreceptor from being charged. The volume resistivity of the layer to be used is preferably $1\times10^{14}$ ohm·cm or lower because too high volume resistivities lead to an increase in residual potential.

Various undercoat layers may be formed by ordinary methods. Namely, the materials to be contained in each layer are dissolved or dispersed in a solvent and the coating fluid obtained is applied on an electroconductive substrate and dried to thereby form the layer. Particles of an inorganic compound, e.g., silica or titanium oxide, particles of an organic compound, photoconductive substance, and other additives such as an antioxidant, dispersant, and leveling agent may be added according to need to the coating fluid as long as the incorporation thereof does not impair the properties of the undercoat layer and the dispersion stability of the coating fluid.

For applying the coating fluid in forming an undercoat layer, any coating technique may be used as long as the coating fluid can be applied evenly in some degree. In general, however, use is made of dip coating, spray coating, nozzle coating, or the like.

Multilayered Photosensitive Layer

Charge Generation Layer

The charge generation layer of a multilayered photosensitive layer can be formed by dispersing a charge generation material in a solvent together with a binder resin and optionally with other ingredients such as an organic photoconductive compound, dye, and electron-attracting compound, applying the coating fluid obtained, and drying the coating.

As the charge generation material for use in the charge generation layer of the photosensitive layer can be used various photoconductive materials including inorganic photoconductive materials such as selenium, alloys thereof, and amorphous silicon and organic pigments such as phthalocyanine pigments, azo pigments, quinacridone pigments, indigo pigments, perylene pigments, polycyclic quinone pigments, anthanthrone pigments, and benzimidazole pigments. It is especially desirable to use an organic pigment, in particular, a phthalocyanine pigment or an azo pigment. In the case where a phthalocyanine pigment is used, examples thereof include metal-free phthalocyanine and phthalocyanine compounds to which a metal, e.g., copper, indium, gallium, tin, titanium, zinc, vanadium, silicon, or germanium, or an oxide, halide, hydroxide, alkoxide, or another form of the metal has coordinated. These phthalocyanine compounds can have various crystal forms. Specifically, preferred examples include the azo pigments described in JP-A-63-259572, JP-A-57-195567, and JP-A-5-32905 and the phthalocyanine pigments described in JP-A-5-98181, JP-A-2-8256, and JP-A-62-67094.

In the case where a phthalocyanine compound is used as a charge generation material, examples thereof include metal-free phthalocyanine and phthalocyanine compounds to which a metal, e.g., copper, indium, gallium, tin, titanium, zinc, vanadium, silicon, or germanium, or an oxide, halide, or another form of the metal has coordinated. Examples of ligands bonded to metal atoms having a valence of 3 or higher include hydroxy, alkoxy groups, and the like besides oxygen and chlorine atoms, which are shown above.

In a preferred embodiment, of the present invention when the photoconductive material of the charge generation material is an organic photoconductive material and the organic photoconductive material is a phthalocyanine pigment, the phthalocyanine pigment is a metal-bound phthalocyanine pigment, with the proviso that when the metal-bound phthalocyanine pigment is a titanyl phthalocyanine, the titanyl phthalocyanine is crystalline.

In a more preferred embodiment are charge generation materials which have especially high sensitivity, such as X-form and τ-form metal-free phthalocyanines, A-form, B-form, D-form, and other titanyl phthalocyanines. Other preferred charge generation materials include: vanadyl phthalocyanine, chloroindium phthalocyanine, chlorogallium phthalocyanine, hydroxygallium phthalocyanine, and the like. Of the crystal forms of titanyl phthalocyanine shown above, the A-form and the B-form are shown as the I-phase and II-phase, respectively, by W. Heller et al. (*Zeit. Kristallogr.,* 159(1982) 173), the A-form being known as a stable form. The D-form is a crystal form characterized by showing a distinct peak at a diffraction angle 2θ±0.2° of 27.3° in X-ray powder diffraction using a $CuK_{\alpha}$ line. A single phthalocyanine compound may be used, or some phthalocyanine compounds in the form of a mixture thereof may be used. With respect to the mixed state of the phthalocyanine compounds or in the crystal state, the constituent elements may be mixed later and used. Alternatively, the compounds may be ones which were made to come into the mixed state in phthalocyanine compound production/treatment steps including synthesis, pigment preparation, and crystallization. Known such treatments include an acid paste treatment, grinding treatment, solvent treatment, and the like.

The binder resin to be used for binding the charge generation layer together with the charge generation material may be the polyarylate resin according to the invention or may be another resin. Two or more resins may be used in combination. Preferred examples of the binder resin include polyester resins, poly(vinyl acetate), polyesters, polycarbonates, poly(vinyl acetoacetal), poly(vinyl propional), poly (vinyl butyral), phenoxy resins, epoxy resins, urethane resins, cellulose esters, cellulose ethers, polymers and copolymers of vinyl compounds such as styrene, vinyl acetate, vinyl chloride, acrylic esters, methacrylic esters, vinyl alcohol, and ethyl vinyl ether, polyamides, and silicon resins.

The proportions of the charge generation material and binder resin to be used are not particularly limited. However, the amount of the binder resin may be in the range of 1–2,000 parts by weight, preferably 10–500 parts by weight, per 100 parts by weight of the charge generation material. Too high proportions of the charge generation material result in reduced stability of the coating fluid, while too low proportions thereof result in an elevated residual potential. Consequently, the proportion thereof is desirably within that range.

For conducting a treatment for dispersing the charge generation material in a coating fluid, known techniques can be used. For example, dispersion techniques employing a ball mill, sand grinding mill, planetary mill, roll mill, paint shaker, or the like can be used.

Examples of the organic solvent to be used for the coating fluid include ethers such as tetrahydrofuran, dioxane, and ethylene glycol monomethyl ether, ketones such as acetone, methyl ethyl ketone, and cyclohexanone, aromatic hydrocarbons such as toluene and xylene, halogenated aromatic hydrocarbons such as monochlorobenzene and dichlorobenzene, alcohols such as methanol, ethanol, and isopropanol, esters such as methyl acetate and ethyl acetate, amides such as N,N-dimethylformamide and N,N-dimethylacetamide, and sulfoxides such as dimethyl sulfoxide. One or more solvents suitably selected from these are used to prepare a dispersion of the charge generation material.

The charge generation layer may contain various additives according to need, such as a leveling agent for improving applicability, an antioxidant, and a sensitizer.

The thickness of the charge generation layer desirably is generally 0.05–5 μm, preferably from 0.1 μm to 2 μm, more preferably from 0.15 μm to 1 μm. The charge generation layer may be a film of the charge generation material formed by vapor deposition.

Charge Transport Layer

The charge transport layer of a multilayered photosensitive layer can be formed by mixing a charge transport material and a binder resin with a solvent optionally together with other additives, applying the coating fluid obtained, and drying the coating.

Examples of the charge transport material include electron-attracting substances such as aromatic nitro compounds, e.g., 2,4,7-trinitrofluorenone, cyano compounds, e.g., tetracyanoquinodimetan, and quinones, e.g., diphenoquinone; and electron-donating substances such as heterocyclic compounds, e.g., carbazole derivatives, indole derivatives, imidazole derivatives, oxazole derivatives, pyrazole derivatives, and thiadiazole derivatives, aniline derivatives, hydrazone compounds, aromatic amine derivatives, stilbene derivatives, butadiene derivatives, compounds made up of two or more of these compounds bonded to each other, and polymers having a group derived from any of these compounds in the main chain or a side chain.

Preferred of these are carbazole derivatives, hydrazone compounds, aromatic amine derivatives, stilbene derivatives, butadiene derivatives, and compounds made up of two or more of these derivatives bonded to each other.

It is more preferred to use the charge transport material shown in JP-A-2-230255, the charge transport material shown in JP-A-63-225660, the charge transport material shown in JP-A-58-198043, the charge transport material shown in JP-B-58-32372, the charge transport material shown in JP-B-7-21646, a charge transport material having a structure represented by the following formula (7), or a charge transport material represented by the following formula (8). Especially preferably, the charge transport material having a structure represented by one of formulae (7)–(10) is used, wherein formula (9) is described in JP-A-58-198043 and formula (10) is described in JP-B-58-32372.

(8)

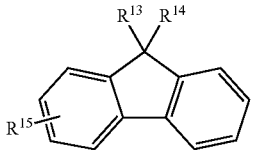

In formula (8), $R^{13}$ and $R^{14}$ represent an alkyl group which may have one or more substituents or a hydrogen atom. $R^{15}$ represents a diarylamino group which may have one or more substituents.

In formula (7), $R^5$ to $R^{12}$ each independently represents a hydrogen atom, an alkyl group which may have one or more substituents, an aryl group which may have one or more substituents, an aralkyl group which may have one or more substituents, or a heterocyclic group which may have one or more substituents. Examples of the alkyl groups include methyl, ethyl, propyl, isopropyl, butyl, pentyl, hexyl, heptyl, cyclopentyl, and cyclohexyl. Preferred of these are the alkyl groups having 1–6 carbon atoms. In the case where the alkyl groups have an aryl substituent, examples thereof include benzyl and phenethyl, and aralkyl groups having 7–12 carbon atoms are preferred.

Examples of the aryl group include phenyl, tolyl, xylyl, naphthyl, and pyrenyl. Preferred are aryl groups having 6–12 carbon atoms.

The heterocyclic group preferably is a heterocycle having aromaticity. Examples thereof include furyl, thienyl, and pyridyl. More preferred are monocyclic aromatic heterocycles. However, within the context of the present invention, it is possible that each heterocyclic group within the ring system may have a total ring size of 5–7 atoms, may have one or two heteroatoms selected from N, O, and S (and combinations thereof). Of course, in the case of fused ring systems one or more of the rings may be a heterocyclic group.

Most preferred examples of $R^5$ to $R^{12}$ are hydrogen atom, methyl, and phenyl.

(7)

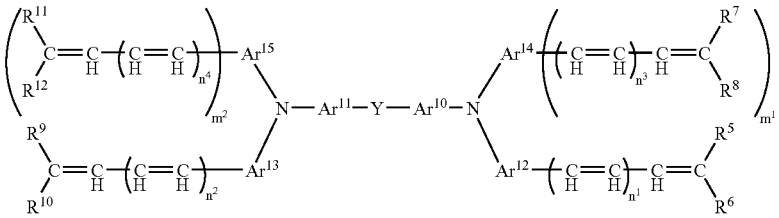

In formula (7), $Ar^{10}$ to $Ar^{15}$ each independently represents an arylene group which may have one or more substituents or a divalent heterocyclic group which may have one or more substituents. Symbols $m^1$ and $m^2$ each independently represents 0 or 1. $Ar^{14}$ when $m^1=0$ and $Ar^{15}$ when $m^2=0$ each represents an aryl group which may have one or more substituents, or a monovalent aromatic heterocyclic group which may have one or more substituents, while $Ar^{14}$ when $m^1=1$ and $Ar^{15}$ when $m^2=1$ each represents an arylene group which may have one or more substituents, or a divalent aromatic heterocyclic group which may have one or more substituents. Y represents a direct bond between $Ar^{10}$ and $Ar^{11}$ (i.e., no atom present) or a divalent connecting group. $R^5$ to $R^{12}$ each independently represents a hydrogen atom, an alkyl group which may have one or more substituents, an aryl group which may have one or more substituents, or a heterocyclic group which may have one or more substituents. Symbols $n^1$ to $n^4$ each independently represents an integer of 0 to 4. At least two of $Ar^{10}$ to $Ar^{15}$ may be bonded to each other to form a cyclic structure.

As stated above, in formula (7), $Ar^{10}$ to $Ar^{15}$ each independently represents an arylene group which may have one or more substituents or a divalent heterocyclic group which may have one or more substituents; $m^1$ and $m^2$ each independently represents 0 or 1; and $Ar^{14}$ when $m^1=0$ and $Ar^{15}$ when $m^2=0$ each represents an aryl group which may have one or more substituents, or a monovalent aromatic heterocyclic group which may have one or more substituents, while $Ar^{14}$ when $m^1=1$ and $Ar^{15}$ when $m^2=1$ each represents an alkylene group which may have one or more substituents, an arylene group which may have one or more substituents, or a divalent heterocyclic group which may have one or more substituents. Examples of the aryl group include phenyl, tolyl, xylyl, naphthyl, and pyrenyl, and preferred are aryl groups having 6–14 carbon atoms. Examples of the arylene group include phenylene and naphthylene, and phenylene is preferred. The monovalent heterocyclic group preferably is a heterocycle having aromaticity, and examples thereof include furyl, thienyl, and pyridyl. Monocyclic aromatic heterocycles are more preferred. The divalent heterocyclic group preferably is a heterocycle having aromaticity, and examples thereof include pyridylene and thienylene. Monocyclic aromatic heterocycles are more preferred.

Most preferred of these are phenylene for $Ar^{10}$ and $Ar^{11}$ and phenylene for $Ar^{12}$ and $Ar^{13}$, and phenyl for $Ar^{14}$ and $Ar^{15}$.

Of those groups represented by $R^5$ to $R^{12}$ and $Ar^{10}$ to $Ar^{15}$, as appropriate based on the definition of potential substitutents for each group defined above, the alkyl group, aryl group, aralkyl group, and heterocyclic group may further have substituents. Examples of the substituents include cyano; nitro; hydroxy; halogen atoms such as fluorine, chlorine, bromine, and iodine atoms; alkyl groups such as methyl, ethyl, propyl, isopropyl, butyl, isobutyl, s-butyl, t-butyl, pentyl, hexyl, cyclopentyl, and cyclohexyl; alkoxy groups such as methoxy, ethoxy, and propyloxy; alkylthio groups such as methylthio and ethylthio; alkenyl groups such as vinyl and allyl; aralkyl groups such as benzyl, naphthylmethyl, and phenethyl; aryloxy groups such as phenoxy and tolyloxy; aralkyloxy groups such as benzyloxy and phenethyloxy; aryl groups such as phenyl and naphthyl; arylvinyl groups such as styryl and naphthylvinyl; acyl groups such as acetyl and benzoyl; dialkylamino groups such as dimethylamino and diethylamino; diarylamino groups such as diphenylamino and dinaphthylamino; diaralkylamino groups such as dibenzylamino and diphenethylamino; di(heterocycle)amino groups such as dipyridylamino and dithienylamino; and substituted amino groups such as diallylamino and di-substituted amino groups having a combination of two of those substituents for amino.

These substituents may be bonded to each other through a single bond, methylene group, ethylene group, carbonyl group, vinylidene group, ethylenylene group, or the like to form a cyclic hydrocarbon group or heterocyclic group.

Preferred examples of those substituents include halogen atoms, cyano, hydroxy, alkyl groups having 1–6 carbon atoms, alkoxy groups having 1–6 carbon atoms, alkylthio groups having 1–6 carbon atoms, aryloxy groups having 6–12 carbon atoms, arylthio groups having 6–12 carbon atoms, and dialkylamino groups having 2–8 carbon atoms. More preferred are halogen atoms, alkyl groups having 1–6 carbon atoms, and phenyl. Especially preferred are methyl and phenyl.

Symbols $n^1$ to $n^4$ in formula (7), which each independently represents an integer of 0 to 4, preferably is 0 to 2, and especially preferably is 1. Symbols $m^1$ and $m^2$, which represent 0 or 1, preferably are 0.

Y in formula (7) represents a direct bond or a divalent residue. Preferred examples of the divalent residue include atoms in Group 16, alkylenes which may have one or more substituents, arylene groups which may have one or more substituents, cycloalkylidene groups which may have one or more substituents, and residues made up of two or more thereof which are bonded to each other, such as, e.g., [—O-Z-O—], [-Z-O-Z-], [-S-Z-S-], and [-Z-Z-] (wherein O represents an oxygen atom, S represents a sulfur atom, and Z represents an arylene group which may have one or more substituents or an alkylene group which may have one or more substituents).

Preferred examples of the alkylene group constituting Y are ones having 1–6 carbon atoms, and more preferred of these are methylene and ethylene. Preferred examples of the cycloalkylidene group are ones having 5–8 carbon atoms, and more preferred of these are cyclopentylidene and cyclohexylidene. Preferred examples of the arylene group include ones having 6–14 carbon atoms, and more preferred of these are phenylene and naphthylene.

These alkylene groups, arylene groups, and cycloalkylidene groups may have substituents. Preferred examples of the substituents include hydroxy, nitro, cyano, halogen atoms, alkyl groups having 1–6 carbon atoms, alkenyl groups having 1–6 carbon atoms, and aryl groups having 6–14 carbon atoms.

$R^{13}$ and $R^{14}$ in formula (8), which represent an alkyl group which may have one or more substituents or a hydrogen atom, preferably are an alkyl group which may have one or more substituents. Preferred of such alkyl groups are ones each having 1–10 carbon atoms in total. More preferred are chain alkyls. Especially preferably, $R^{13}$ and $R^{14}$ are methyl.

$R^{15}$ in formula (8) represents a diarylamino group which may have one or more substituents. Examples of the optionally substituted aryl groups contained in the diarylamino group include aromatic groups such as phenyl, naphthyl, and anthryl and heterocyclic groups such as pyridyl, thienyl, and furyl. Preferred of these are aromatic groups which may have one or more substituents. More preferred is phenyl which may have one or more substituents.

Examples of the substituents which may be possessed by the optionally substituted diarylamino group represented by $R^{15}$ include alkyl groups, aralkyl groups, halogen atoms, and nitro. Preferred of these are alkyl groups. More preferred are chain alkyl groups.

Especially preferred is methyl.

(9)

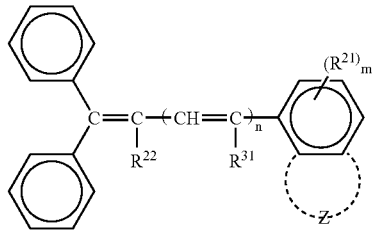

In formula (9), $R^{21}$ represents a hydrogen atom, an alkyl group, an alkoxy group, a halogen atom or a substituted amino group (—$NR^{23}R^{24}$), wherein $R^{23}$ and $R^{24}$ each independently represent an alkyl group, an aralkyl group which may have one or more substituents, or an aryl group which may have one or more substituents, $R^{23}$ and $R^{24}$ may be connected to form a cyclic structure, $R^{22}$ represents a hydrogen atom, an alkyl group, or a phenyl group which may have one or more substituents, $R^{31}$ is a hydrogen atom, an alkyl group which may have one or more substituents, or an aryl group which may have one or more substituents, Z is either not present or represents a benzene structure, a naphthalene structure, or an indole structure, wherein said structure may have one or more substituents.

n represents an integer selected from 0 or 1, and m represents an integer selected from 0, 1, 2, or 3.

Substitutents suitable for use with $R^{22}$ to $R^{24}$ are as defined above for $R^5$ to $R^{12}$ and $Ar^{10}$ to $Ar^{15}$. A non-limiting list of cyclic structures formed when $R^{23}$ and $R^{24}$ include quinoline, isoquinoline, indole, isoindole, piperidine, pyrrolidine, and imidazole.

In regard to $R^{31}$, examples of the alkyl groups include linear and branched alkyl groups such as methyl, ethyl, propyl, butyl, isopropyl, and isobutyl. Examples of the aryl group include phenyl, biphenyl, naphthyl, and phenanthryl. These alkyl and aryl groups may further have substituents, and examples thereof include alkyl groups such as methyl and ethyl; aryl groups such as phenyl, biphenyl, and naphthyl; alkoxy groups such as methoxy, ethoxy, and propyloxy; arlyoxy groups such as phenoxy and tolyloxy; aralkyloxy groups such as benzyloxy, and phenethyloxy; hydroxy; halogen atoms such as chlorine, bromine, and fluorine atoms; alkyl groups such as methyl, ethyl, propyl, isopropyl, butyl, isobutyl, sec-butyl, and t-butyl; acetyl; dialkylamino groups such as dimethylamino, diethylamino, and diisopropylamino; diarylamino groups such as diphenylamino and di-p-tolylamino; and diarylalkylamino groups such as dibenzylamino.

(10)

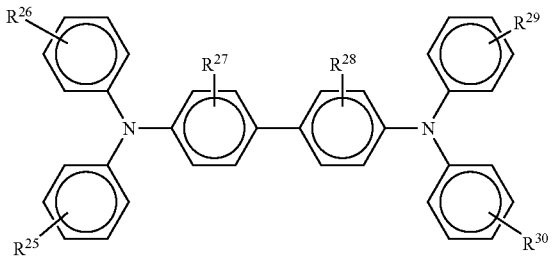

In formula (10), $R^{25}$ to $R^{30}$ each independently represents a hydrogen atom, an alkyl group, an alkoxy group, an aryl group or a halogen atom. Examples of suitable substituents for each of these groups include: alkoxy groups such as methoxy, ethoxy, and propyloxy; aryloxy groups such as phenoxy and tolyloxy; aralkyloxy groups such as benzyloxy, and phenethyloxy; hydroxy; halogen atoms such as chlorine, bromine, and fluorine atoms; alkyl groups such as methyl, ethyl, propyl, isopropyl, butyl, isobutyl, sec-butyl, and t-butyl; and aryl group include phenyl, tolyl, xylyl, naphthyl, and pyrenyl.

In a preferred embodiment, in the structure of formula (10), $R^{26}$—$R^{29}$ are each a hydrogen atom and $R^{25}$ and $R^{30}$ are independently selected from the group consisting of o-$CH_3$, m-$CH_3$, p-$CH_3$, o-Cl, m-Cl, and p-Cl.

Those charge transport materials may be used alone, or some of these may be used as a mixture thereof. A charge transport layer is formed in which any of these charge transport materials is in the state of being bound with a binder resin. The charge transport layer may consist of a single layer or may be composed of superposed layers differing in components or in component proportion.

The binder resin to be used for binding the charge transport layer together with the charge transport material may be the polyarylate resin according to the invention or may be another resin. Two or more resins may be used in combination. Preferred examples of the binder resin include vinyl polymers such as poly(methyl methacrylate), polystyrene, and poly(vinyl chloride) and copolymers of these, polycarbonates, polyesters, polyester carbonates, polysulfones, polyimides, phenoxies, epoxies, and silicone resins. Also usable are resins obtained by partly crosslinking/curing these resins or mixtures of these resins.

The proportions of the binder resin and the charge transport material are such that the amount of the charge transport material to be used is in the range of generally 20–200 parts by weight, preferably 30–150 parts by weight, per 100 parts by weight of the binder resin.

In the case of a multilayered photosensitive layer, the thickness of the charge transport layer to be used is 5–60 μm, preferably 10–45 μm.

Single-Layer Photosensitive Layer

A single-layer photosensitive layer consists of one photosensitive layer comprising a charge generation material usable in the charge generation layer of the multilayered photosensitive layer, a charge transport material usable in the charge transport layer of the multilayered photosensitive layer, and a binder resin. This photosensitive layer may contain other additives according to need, and may have an overcoat layer.

The charge generation material, charge transport material, and binder resin may be the same as those for use in multilayered electrophotographic photoreceptors, and can be used in the same manner.

The particle diameter of the charge generation material in the case of a single-layer photosensitive layer should be sufficiently small so as to avoid the influence of exposure light scattering. The particle diameter of the charge generation material to be used is preferably 1 μm or smaller, more preferably 0.5 μm or smaller. The amount of the charge generation material to be dispersed in the photosensitive layer is in the range of, for example, 0.5–50% by weight. However, too small amounts thereof result in insufficient sensitivity, while too large amounts thereof exert adverse influences such as reduced electrification characteristics and reduced sensitivity. More preferably, the charge generation material is used in an amount in the range of 1–20% by weight. The thickness of the single-layer photosensitive layer to be used is generally 5–50 μm, more preferably 10–45 μm.

Additives

Examples of additives usable in the photosensitive layer according to need include known plasticizers and crosslinking agents for improving film-forming properties, flexibility, and mechanical strength, and other additives including antioxidants, stabilizers, sensitizers, various leveling agents for improving applicability, and dispersion aids. Examples of the plasticizers include phthalic esters, phosphoric esters, epoxy compounds, chlorinated paraffins, chlorinated fatty acid esters, and aromatic compounds such as methylnaphthalene. Examples of the leveling agents include silicone oils and fluorochemical oils.

Other Functional Layers

It is a matter of course that the photoreceptor of the invention may further have other layers according to need, e.g., an overcoat layer and a charge injection layer, so as to have improved electrical properties and improved mechanical properties.

Method of Layer Formation by Coating

Coating fluids for forming the photosensitive layer and other functional layers may be applied by known coating techniques in ordinary use for forming the photosensitive layers of electrophotographic photoreceptors. For example, the coating fluids can be applied by coating techniques such as dip coating, spray coating, spiral coating, spinner coating, bead coating, wire-wound bar coating, blade coating, roller coating, curtain coating, and ring coating.

In the case where a charge transport layer or a single-layer photosensitive layer is formed by dip coating, the concentration of all solid ingredients in the coating fluid is preferably 15–40%. The viscosity of the coating fluid is regulated to generally 50–500 cP, preferably 100–400 cP. The viscosity of the coating fluid is determined virtually by the kind and molecular weight of the binder polymer. However, in case where the binder polymer has too low a molecular weight, the polymer itself has reduced mechanical strength. It is therefore preferred to use a binder polymer having a molecular weight which does not impair the property. The coating fluid thus prepared is used to form a charge transport layer by dip coating.

For drying the layers after application, any known technique can be employed. In the case of a charge generation layer, it is preferred to conduct the drying at a temperature of 25–250° C. for a period in the range of from 5 minutes to 3 hours either in a static atmosphere or with air blowing. In the case of a charge transport layer and a single-layer photosensitive layer, the coating fluid applied can be dried with a hot-air drying oven, steam dryer, infrared dryer, or far-infrared dryer at a temperature in the range of generally 100–250° C., preferably 110–170° C., more preferably 120–140° C.

The electrophotographic photoreceptor of the invention thus obtained retains excellent printing durability and slip properties over long. It is suitable for use in the field of electrophotography such as copiers, printers, facsimile telegraphs, and platemaking machines.

Image-Forming Apparatus

The image-forming apparatus, such as a copier or printer, employing the electrophotographic photoreceptor of the invention involves at least the process steps of charging, exposure, development, and transfer. Each of these process steps may be conducted by any of methods in ordinary use.

As a charging method (charging device) can be used, for example, corotron or scorotron charging, which utilizes corona discharge. Besides these, use may be made of a direct charging technique in which a direct-charging member to which a voltage is applied is brought into contact with the photoreceptor surface to charge it. As the direct charging technique may be used any of contact charging techniques using a conductive roller or a brush, film, or the like. Such charging techniques may be either ones accompanied by an aerial discharge or ones not accompanied by an aerial discharge. Of these charging methods, the charging technique using corona discharge preferably is scorotron charging from the standpoint of keeping the dark potential constant. In the case of a contact charging device employing a conductive roller or the like, the charging can be conducted with a direct current or with a direct current on which an alternating current has been superimposed.

With respect to an exposure light, use may be made of a halogen lamp, fluorescent lamp, laser (semiconductor or He—Ne), LED, internal exposure of the photoreceptor, or the like. However, it is preferred to use a laser, LED, light shutter array, or the like in a digital electrophotographic technique. With respect to wavelength, a monochromatic light having a slightly short wavelength in the 600–700 nm region and a monochromatic light having a short wavelength in the 380–500 nm region can be used besides the monochromatic light having a wavelength of 780 nm.

For the development step may be used dry development techniques such as cascade development, development with a one-component insulating toner, development with a one-component conductive toner, and two-component magnetic brush development, wet development techniques, and other techniques. Usable toners include polymerization toners produced through suspension polymerization or emulsion polymerization and aggregation, besides pulverized toners. Especially in the case of polymerization toners, ones having an average particle diameter as small as about 4–8 μm are used. With respect to shape, usable polymerization toners range from nearly spherical ones to non-spherical potato-shaped ones.

Polymerization toners are excellent in evenness of electrification and in transferability and are suitable for use in image quality improvement.

In the transfer step, use is made of an electrostatic transfer technique, pressure transfer technique, and adhesive transfer technique, such as corona transfer, roller transfer, and belt transfer. For the fixing is used heated-roller fixing, flash fixing, oven fixing, pressure fixing, or the like.

For the cleaning is used a brush cleaner, magnetic brush cleaner, electrostatic brush cleaner, magnetic roller cleaner, blade cleaner, or the like.

The erase step is frequently omitted. When the step is conducted, a fluorescent lamp, LED, or the like is used. With respect to intensity therefor, an exposure energy which is at least 3 times the energy of the exposure light is frequently used. Besides the process steps shown above, a pre-exposure step and an auxiliary charging step may be involved.

Embodiments of the image-forming apparatus employing the electrophotographic photoreceptor of the invention are explained by reference to FIG. 1, which illustrates the important constitution of the apparatus. However, the embodiments should not be construed as being limited to that explained below, and can be modified at will as long as the modifications do not depart from the spirit of the invention.

As shown in FIG. 1, the image-forming apparatus comprises an electrophotographic photoreceptor 1, a charging device 2, an exposure device 3, and a developing device 4. The apparatus may further has a transfer device 5, a cleaner 6, and a fixing device 7 according to need.

The electrophotographic photoreceptor 1 is not particularly limited as long as it is the electrophotographic photoreceptor of the invention described above. FIG. 1 shows, as an example thereof, a drum-shaped photoreceptor comprising a cylindrical electroconductive substrate and, formed on the surface thereof, the photosensitive layer described above. The charging device 2, exposure device 3, developing device 4, transfer device 5, and cleaner 6 are disposed along the peripheral surface of this electrophotographic photoreceptor 1.

The charging device 2 serves to charge the electrophotographic photoreceptor 1. It evenly charges the surface of the electrophotographic photoreceptor 1 to a given potential. FIG. 1 shows a roller type charging device (charging roller) as an example of the charging device 2. However, corona charging devices such as corotrons and scorotrons, contact type charging devices such as charging brushes, and the like are frequently used besides the charging rollers.

In many cases, the electrophotographic photoreceptor 1 and the charging device 2 are designed to constitute a cartridge (hereinafter sometimes referred to as a photoreceptor cartridge) which involves these two members and is removable from the main body of the image-forming apparatus. In this constitution, when, for example, the electrophotographic photoreceptor 1 and the charging device 2 have deteriorated, this photoreceptor cartridge can be removed from the main body of the image-forming apparatus and a fresh photoreceptor cartridge can be mounted in the main body of the image-forming apparatus. Also with respect to the toner which will be described later, the toner in many cases is designed to be stored in a toner cartridge and be removable from the main body of the image-forming apparatus. In this constitution, when the toner in the toner cartridge in use has run out, this toner cartridge can be removed from the main body of the image-forming apparatus and a fresh toner cartridge can be mounted. There are also cases where a cartridge containing all of a photoreceptor 1, a charging device 2, and a toner is used.

The exposure device 3 is not particularly limited in kind as long as it can illuminate the electrophotographic photoreceptor 1 and thereby form an electrostatic latent image in the photosensitive surface of the electrophotographic photoreceptor 1. Examples thereof include halogen lamps, fluorescent lamps, lasers such as semiconductor lasers and He—Ne lasers, and LEDs. It is also possible to conduct exposure by the technique of internal photoreceptor exposure. Any desired light can be used for exposure. For example, the monochromatic light having a wavelength of 780 nm, a monochromatic light having a slightly short wavelength of from 600 nm to 700 nm, a monochromatic light having a short wavelength of from 380 nm to 500 nm, or the like may be used to conduct exposure.

The developing device 4 is not particularly limited in kind, and any desired device can be used, such as one operated by a dry development technique, e.g., cascade development, development with one-component conductive toner, or two-component magnetic brush development, a wet development technique, etc. In FIG. 1, the developing device 4 comprises a developing chamber 41, agitators 42, a feed roller 43, a developing roller 44, and a control member 45. This device has such a constitution that a toner T is stored in the developing chamber 41. According to need, the developing device 4 may be equipped with a replenishing device (not shown) for replenishing the toner T. This replenishing device has such a constitution that the toner T can be supplied from a container such as a bottle or cartridge.

The feed roller 43 is made of an electrically conductive sponge, etc. The developing roller 44 comprises a metallic roll made of iron, stainless steel, aluminum, nickel, or the like, a resinous roll obtained by coating such a metallic roll with a silicone resin, urethane resin, fluororesin, or the like, or the like. The surface of this developing roller 44 may be subjected to a surface-smoothing processing or surface-roughening processing according to need.

The developing roller 44 is disposed between the electrophotographic photoreceptor 1 and the feed roller 43 and is in contact with each of the electrophotographic photoreceptor 1 and the feed roller 43. The feed roller 43 and the developing roller 44 are rotated by a rotation driving mechanism (not shown). The feed roller 43 holds the toner T stored and supplies it to the developing roller 44. The developing roller 44 holds the toner T supplied by the feed roller 43 and brings it into contact with the surface of the electrophotographic photoreceptor 1.

The control member 45 comprises a resinous blade made of a silicone resin, urethane resin, or the like, a metallic blade made of stainless steel, aluminum, copper, brass, phosphor bronze, or the like, a blade obtained by coating such a metallic blade with a resin, etc. This control member 45 is in contact with the developing roller 44 and is pushed against the developing roller 44 with a spring or the like at a given force (the linear blade pressure is generally 5–500 g/cm). According to need, this control member 45 may have the function of charging the toner T based on electrification by friction with the toner T.

The agitators 42 each are rotated by the rotation driving mechanism. They agitate the toner T and convey the toner T to the feed roller 43 side. Two or more agitators 42 differing in blade shape, size, etc. may be disposed.

The toner T may be of any desired kind. Besides powdery toners, polymerization toners produced by using the suspension polymerization method, emulsion polymerization method, or the like can be used. In particular, when a polymerization toner is used, it preferably is one having a particle diameter as small as about 4–8 μm. Furthermore, polymerization toners in which the toner particles range widely in shape from nearly spherical ones to non-spherical potato-shaped ones can be used. Polymerization toners are excellent in evenness of electrification and in transferability and are suitable for use in image quality improvement.

The transfer device 5 is not particularly limited in kind, and use can be made of a device operated by any desired technique selected from an electrostatic transfer technique, pressure transfer technique, adhesive transfer technique, and the like, such as corona transfer, roller transfer, and belt transfer. Here, the transfer device 5 is one constituted of a transfer charger, transfer roller, transfer belt, or the like disposed so as to face the electrophotographic photoreceptor 1. A given voltage (transfer voltage) which has the polarity opposite to that of the charge potential of the toner T is applied to the transfer device 5, and this transfer device 5 thus transfers the toner image formed on the electrophotographic photoreceptor 1 to a recording paper (paper or medium) P.

The cleaner 6 is not particularly limited, and any desired cleaner can be used, such as a brush cleaner, magnetic brush cleaner, electrostatic brush cleaner, magnetic roller cleaner, or blade cleaner. The cleaner 6 serves to scrape off the residual toner adherent to the photoreceptor 1 with a cleaning member and thus recover the residual toner.

The fixing device 7 is constituted of an upper fixing member (fixing roller) 71 and a lower fixing member (fixing roller) 72. The fixing member 71 or 72 is equipped with a heater 73 inside. FIG. 1 shows an example in which the upper fixing member 71 is equipped with a heater 73 inside. As the upper and lower fixing members 71 and 72 can be used a known heat-fixing member such as a fixing roll comprising a metallic tube made of stainless steel, aluminum, or the like and a silicone rubber with which the tube is coated, a fixing roll obtained by further coating the fixing roll with a TEFLON™ resin, or a fixing sheet with a TEFLON™ resin. Furthermore, the fixing members 71 and 72 each may have a constitution in which a release agent such as a silicone oil is supplied thereto in order to improve release properties, or may have a constitution in which the two members are forcedly pressed against each other with a spring or the like.

The toner which has been transferred to the recording paper P passes through the nip between the upper fixing member 71 heated at a given temperature and the lower fixing member 72, during which the toner is heated to a molten state. After the passing, the toner is cooled and fixed to the recording paper P.

The fixing device also is not particularly limited in kind. Fixing devices which can be mounted include a fixing device operated by any desired fixing technique, such as heated-roller fixing, flash fixing, oven fixing, or pressure fixing, besides the device used here.

In the electrophotographic apparatus having the constitution described above, image recording is conducted in the following manner. First, the surface (photosensitive surface) of the photoreceptor 1 is charged to a given potential (e.g., −600 V) with the charging device 2. This charging may be conducted with a direct-current voltage or with a direct-current voltage on which an alternating-current voltage has been superimposed.

Subsequently, the charged photosensitive surface of the photoreceptor 1 is exposed with the exposure device 3 according to the image to be recorded. Thus, an electrostatic latent image is formed in the photosensitive surface. This electrostatic latent image formed in the photosensitive surface of the photoreceptor 1 is developed by the developing device 4.

In the developing device 4, the toner T fed by the feed roller 43 is formed into a thin layer with the control member (developing blade) 45 and, simultaneously therewith, frictionally charged so as to have a given polarity (here, the toner is charged so as to have negative polarity, which is the same as the polarity of the charge potential of the photoreceptor 1). This toner T is conveyed while being held by the developing roller 44 and is brought into contact with the surface of the photoreceptor 1.

When the charged toner T held on the developing roller 44 comes into contact with the surface of the photoreceptor 1, a toner image corresponding to the electrostatic latent image is formed on the photosensitive surface of the photoreceptor 1. This toner image is transferred to a recording paper P with the transfer device 5. Thereafter, the toner which has not been transferred and remains on the photosensitive surface of the photoreceptor 1 is removed with the cleaner 6.

After the transfer of the toner image to the recording paper P, the recording paper P is passed through the fixing device 7 to thermally fix the toner image to the recording paper P. Thus, a finished image is obtained.

Incidentally, the image-forming apparatus may have a constitution in which an erase step, for example, can be conducted, in addition to the constitution described above. The erase step is a step in which the electrophotographic photoreceptor is exposed to a light to thereby erase the residual charges from the electrophotographic photoreceptor. As an eraser is used a fluorescent lamp, LED, or the like. The light to be used in the erase step, in many cases, is a light having such an intensity that the exposure energy thereof is at least 3 times the energy of the exposure light.

The constitution of the image-forming apparatus may be further modified. For example, the apparatus may have a constitution in which steps such as a pre-exposure step and an auxiliary charging step can be conducted, or have a constitution in which offset printing is conducted. Furthermore, the apparatus may have a full-color tandem constitution employing two or more toners.

The above written description of the invention provides a manner and process of making and using it such that any person skilled in this art is enabled to make and use the same, this enablement being provided in particular for the subject matter of the appended claims, which make up a part of the original description.

As used above, the phrases "selected from the group consisting of," "chosen from," and the like include mixtures of the specified materials.

Where a numerical limit or range is stated herein, the endpoints are included. Also, all values and subranges within a numerical limit or range are specifically included as if explicitly written out.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein.

Having generally described this invention, a further understanding can be obtained by reference to certain specific examples, which are provided herein for purposes of illustration only, and are not intended to be limiting unless otherwise specified.

EXAMPLES

Production of Photoreceptor

Example 1

An electroconductive substrate obtained by forming an aluminum layer (thickness, 70 nm) by vapor deposition on a surface of a biaxially stretched poly(ethylene terephthalate) resin film (thickness, 75 μm) was used. The dispersion for undercoat layer formation described below was applied to the vapor-deposited layer of the substrate with a bar coater in an amount sufficient to provide a thickness after drying of 1.25 μm. The coating was dried to form an undercoat layer.

Rutile-form titanium oxide having an average primary-particle diameter of 40 nm ("TTO55N" manufactured by Ishihara Sangyo Ltd.) was mixed with 3% by weight methyldimethoxysilane, based on the titanium oxide, using a ball mill. The resultant slurry was dried, subsequently washed with methanol, and dried. The obtained hydrophobized titanium oxide was dispersed in a methanol/1-propanol mixed solvent with a ball mill to produce a dispersion slurry of the hydrophobized titanium oxide. This dispersion slurry was stirred and mixed with a methanol/1-propanol/toluene (7/1/2 by weight) mixed solvent and pellets of a copolyamide formed from ϵ-caprolactam/bis(4-amino-3-methylphenyl)methane/hexamethylenediamine/deca-methylenedicarboxylic acid/octadecamethylenedicarboxylic acid (proportions: 75/9.5/3/9.5/3 in mol %) with heating to dissolve the polyamide pellets. Thereafter, the resultant mixture was treated with ultrasonic dispersion to produce a dispersion that contained the hydrophobized titanium oxide and the copolyamide in a weight ratio of 3/1 and had a solid concentration of 18.0%.

150 parts by weight of 4-methyl-4-methoxy-2-pentanone was added to 10 parts by weight of D-form oxytitanium phthalocyanine (having an X-ray powder diffraction spectrum having an intense peak at a Bragg angle 2θ (±0.2°) of 27.3° when examined with $CuK_\alpha$ characteristic X-ray) as a charge generation material. This mixture was pulverization treated in which the mixture was pulverized with a sand grinding mill for 1 hour. Thereafter, the resultant suspension was mixed with 100 parts by weight of a 10% by weight 1,2-dimethoxyethane solution of poly(vinyl butyral) ("Denka Butyral #6000C" manufactured by Denki Kagaku Kogyo K.K.) as a binder resin to prepare a coating fluid for charge generation layer formation. This coating fluid was applied on the undercoat layer of the electroconductive substrate with a bar coater in an amount sufficient to provide a thickness after drying of 0.4 μm. The coating was dried to form a charge generation layer.

On this charge generation layer, a solution prepared by dissolving 5 parts by weight of Compound (1)-15 shown in Table 1 [synthesized by the method described in *J. Photopolymer Sci. & Tech.*, Vol. 11, 33(1998)], 100 parts by weight of a polyarylate resin (PAR-1) having the structure shown below, and 50 parts by weight of a charge transport material (CTM-1) consisting of a mixture of structural isomers having the structure shown below in 800 parts by weight of tetrahydrofuran and 200 parts by weight of toluene was applied with a film applicator. This solution was applied in an amount sufficient to provide a thickness after drying of 25 μm to thereby form a charge transport layer. Thus, a photoreceptor was produced.

In CTM-1, one of $X^1$ and $X^2$ is a hydrogen atom and the other is the group shown by $Q^1$. One of $X^3$ and $X^4$ is a hydrogen atom and the other is the group shown by $Q^1$.

Example 2

A photoreceptor was produced in the same manner as in Example 1, except that the amount of the Compound (1)-15 used in the charge transport layer in Example 1 was changed to 1 part by weight.

Example 3

A photoreceptor was produced in the same manner as in Example 1, except that the amount of the Compound (1)-15 used in the charge transport layer in Example 1 was changed to 10 parts by weight.

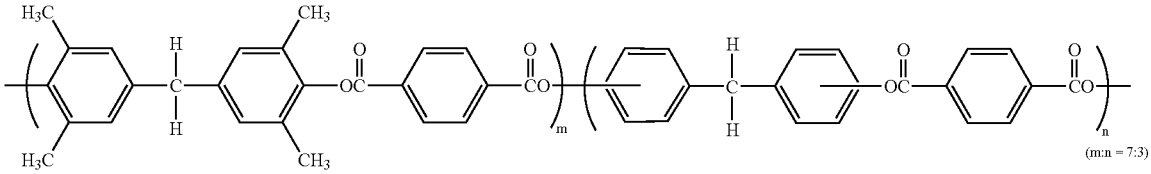

PAR-1

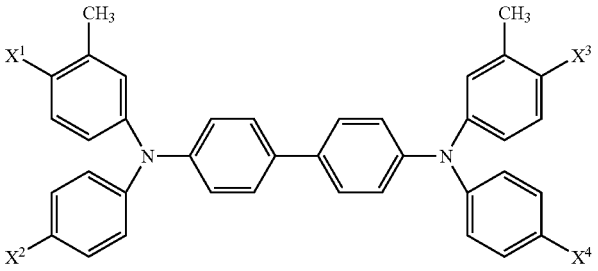

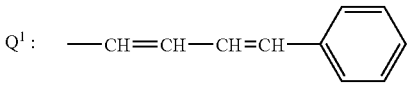

CTM-1

Comparative Example 1

A photoreceptor was produced in the same manner as in Example 1, except that the Compound (1)-15 used in the charge transport layer in Example 1 was omitted.

Example 4

A photoreceptor was produced in the same manner as in Example 1, except that Compound (3)-10 shown in Table 3 was used in place of the Compound (1)-15 used in the charge transport layer in Example 1.

Example 5

A photoreceptor was produced in the same manner as in Example 1, except that Compound (3)-22 shown in Table 3 was used in place of the Compound (1)-15 used in the charge transport layer in Example 1.

Example 6

A photoreceptor was produced in the same manner as in Example 1, except that Compound (3)-19 shown in Table 3 was used in place of the Compound (1)-15 used in the charge transport layer in Example 1.

Example 7

A photoreceptor was produced in the same manner as in Example 1, except that Compound (3)-13 shown in Table 3 was used in place of the Compound (1)-15 used in the charge transport layer in Example 1.

Example 8

A photoreceptor was produced in the same manner as in Example 1, except that Compound (1)-1 was used in place of the Compound (1)-15 used in the charge transport layer in Example 1.

Example 9

A photoreceptor was produced in the same manner as in Example 1, except that C.I. Solvent Orange 60 was used in place of the Compound (1)-15 used in the charge transport layer in Example 1.

Example 10

A photoreceptor was produced in the same manner as in Example 1, except that C.I. Solvent Red 117 was used in place of the Compound (1)-15 used in the charge transport layer in Example 1.

Comparative Example 2

A photoreceptor was produced in the same manner as in Example 1, except that the compound having the structure shown below (Compound A) was used in place of the Compound (1)-15 used in the charge transport layer in Example 1.

Compound A

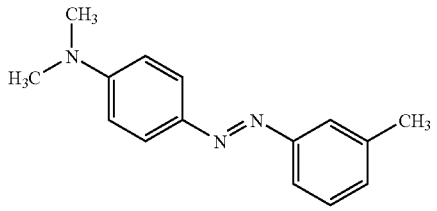

Comparative Example 3

A photoreceptor was produced in the same manner as in Example 1, except that the compound having the structure shown below (Compound B) was used in place of the Compound (1)-15 used in the charge transport layer in Example 1.

Compound B

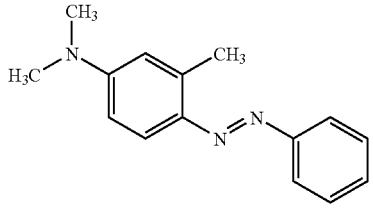

Comparative Example 4

A photoreceptor was produced in the same manner as in Example 1, except that 8 parts by weight of the hindered phenol compound having the structure shown below was used in place of the Compound (1)-15 used in the charge transport layer in Example 1.

Hindered Phenol Compound

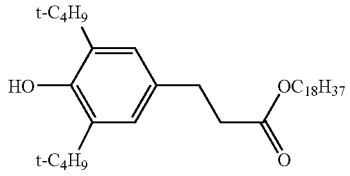

Example 11

A photoreceptor was produced in the same manner as in Example 1 except the following. The hydrophobic titanium oxide used in the undercoat layer in Example 1 was replaced by alumina (Aluminum Oxide C, manufactured by Nippon Aerosil Co., Ltd.), and the proportion of the alumina to the copolyamide in the undercoat layer was regulated to 1/1 by weight. Furthermore, the polyarylate resin used in Example 1 was replaced by a polyarylate resin (PAR-2) having the structure shown below, and the charge transport material was replaced by a charge transport material (CTM-2) having the structure shown below. In addition, the Compound (1)-15 was replaced by Compound (3)-13 shown in Table 3.

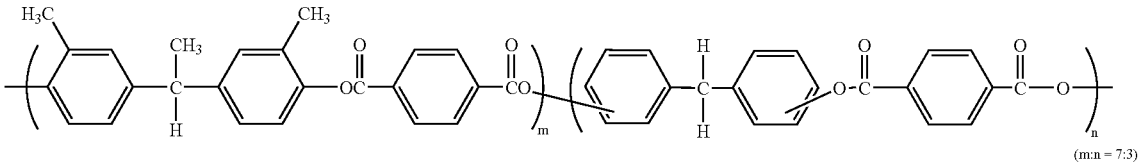

(m:n = 7:3)

PAR-2

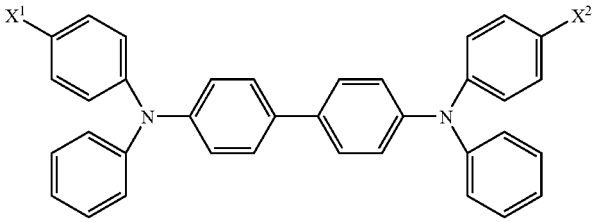

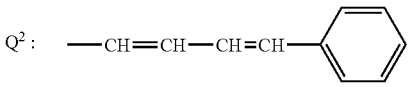

CTM-2

In CTM-2, $X^1$ and $X^2$ are the group shown by $Q^2$.

Comparative Example 5

A photoreceptor was produced in the same manner as in Example 11, except that the Compound (3)-13 used in the charge transport layer in Example 11 was omitted.

Example 12

A photoreceptor was produced in the same manner as in Example 11, except that a mixture of 90 parts by weight of a polyarylate resin (PAR-3) having the structure shown below and 10 parts by weight of a polycarbonate resin having the structure shown below was used in place of 100 parts by weight of the polyarylate resin used in Example 11.

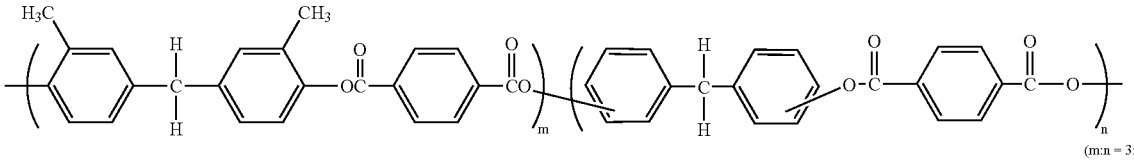

(m:n = 3:7)

PAR-3

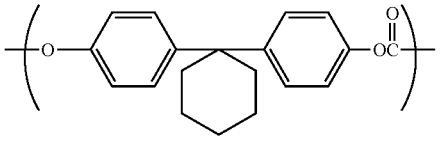

PCR-1

Comparative Example 6

A photoreceptor was produced in the same manner as in Example 12, except that the Compound (3)-13 used in Example 12 was not used.

Example 13

A charge generation layer was formed on a vapor-deposited aluminum layer in the same manner as in Example 1 except the following. Use was made of A-form hydroxytitanium phthalocyanine, which gives an X-ray powder diffraction spectrum having intense diffraction peaks at Bragg angles (2θ±0.20) of 9.3°, 10.6°, and 26.3° when examined with $CuK_\alpha$ characteristic X-ray, in place of the D-form oxytitanium phthalocyanine used in Example 1. The amount of the poly(vinyl butyral) ("Denka Butyral #6000C" manufactured by Denki Kagaku Kogyo K.K.) was changed to 5% by weight and a phenoxy resin ("PKHH" manufactured by Union Carbide Corp.) was added in an amount of 5% by weight. Furthermore, the undercoat layer was omitted.

This charge generation layer was coated in the same manner as in Example 1, except that a polyarylate resin (PAR-4) having the structure shown below was used in place of the polyarylate resin used in Example 1 and that 60 parts by weight of the charge transport material (CTM-3) having the structure shown below was used in place of the charge transport material used in Example 1. Thus, a photoreceptor was produced.

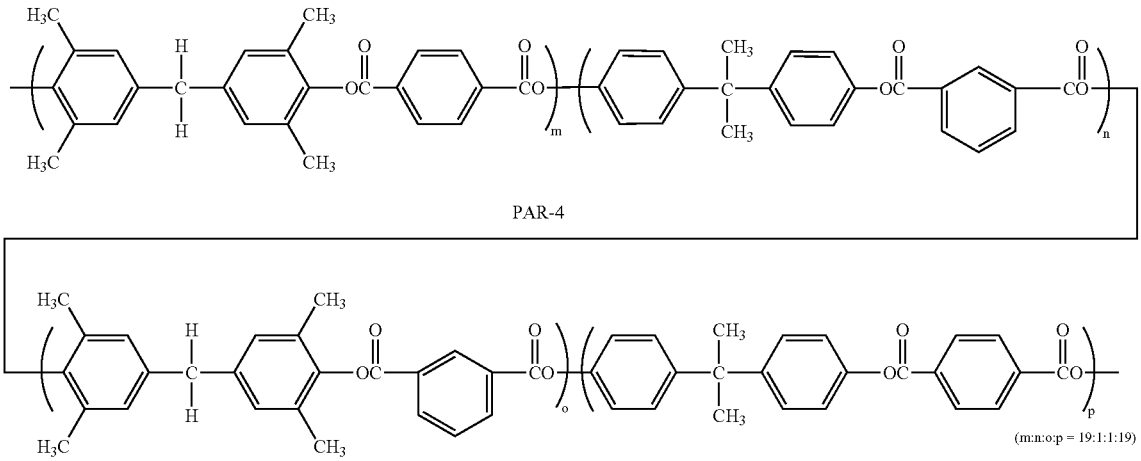

PAR-4

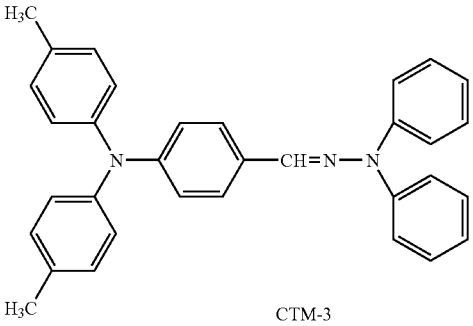

CTM-3

Comparative Example 7

A photoreceptor was produced in the same manner as in Example 13, except that the Compound (1)-15 used in Example 13 was not used.

Example 14

A photoreceptor was produced in the same manner as in Example 13, except that the same polyarylate resin/polycarbonate resin mixture as that used in Example 12 was used in place of 100 parts by weight of the polyarylate resin (PAR-4) used in Example 13.

Comparative Example 8

A photoreceptor was produced in the same manner as in Example 14, except that the Compound (1)-15 used in Example 14 was omitted.

Example 15

A photoreceptor was produced in the same manner as in Example 14, except that 50 parts by weight of a polyarylate resin (PAR-5) having the structure shown below, 50 parts by weight of a polycarbonate resin (PCR-2) having the structure shown below, 70 parts by weight of the charge transport material (CTM-4) having the structure shown below, and 5 parts by weight of Compound (5)-1 shown in Table 5 were used respectively in place of the polyarylate resin, polycarbonate resin, charge transport material, and Compound (1)-15 used in Example 14.

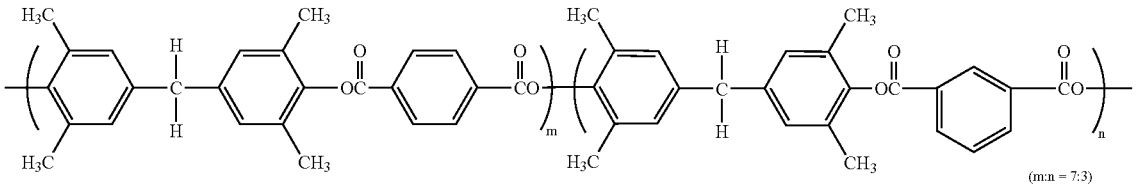

PAR-5

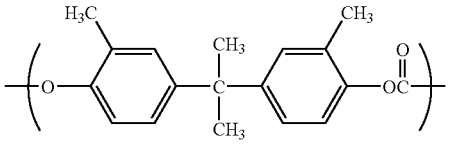

PCR-2

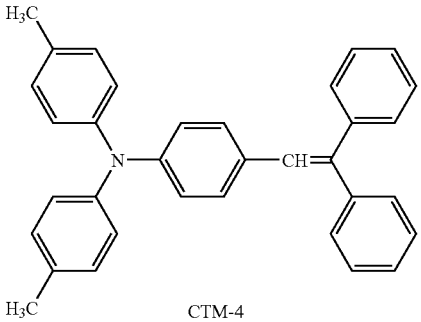

CTM-4

Comparative Example 9

A photoreceptor was produced in the same manner as in Example 15, except that the Compound (5)-1 used in Example 15 was omitted.

Example 16

A photoreceptor was produced in the same manner as in Example 14, except that 70 parts by weight of PAR-1, 30 parts by weight of PCR-2, 60 parts by weight of the charge transport material (CTM-5) having the structure shown below, and 5 parts by weight of Compound (4)-17 shown in Table 4 were used respectively in place of the polyarylate resin, polycarbonate resin, charge transport material, and Compound (1)-15 used in Example 14.

CTM-5

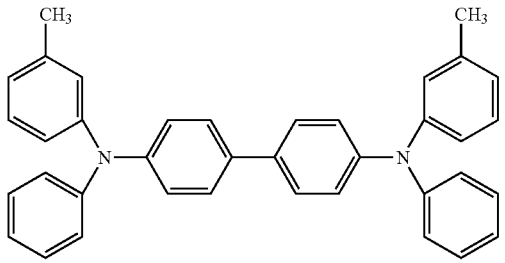

Comparative Example 10

A photoreceptor was produced in the same manner as in Example 16, except that the Compound (4)-17 used in Example 16 was omitted.

Example 17

A photoreceptor was produced in the same manner as in Example 13, except that 100 parts by weight of PAR-2, 30 parts by weight of a charge transport material (CTM-6) having the structure shown below, and 5 parts by weight of Compound (4)-22 shown in Table 4 were used respectively in place of the polyarylate resin, charge transport material, and Compound (1)-15 used in Example 13.

CTM-6

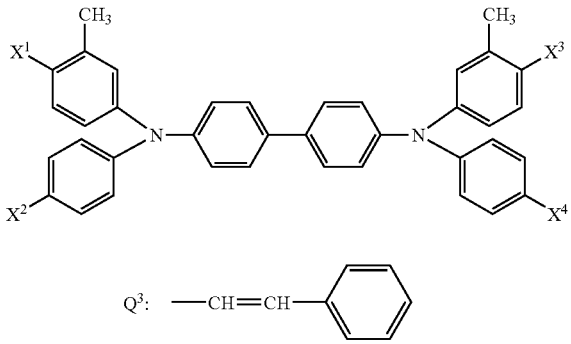

In CTM-6, one of $X^1$ and $X^2$ is a hydrogen atom and the other is the group shown by $Q^3$. One of $X^3$ and $X^4$ is a hydrogen atom and the other is the group shown by $Q^3$.

Comparative Example 11

A photoreceptor was produced in the same manner as in Example 17, except that the Compound (4)-22 used in Example 17 was omitted.

Example 18

A photoreceptor was produced in the same manner as in Example 11, except that 100 parts by weight of PAR-5, 50 parts by weight of the charge transport material (CTM-7) having the structure shown below, and C.I. Solvent Orange 60 were used respectively in place of the polyarylate resin, charge transport material, and Compound (1)-15 used in Example 11.

CTM-7

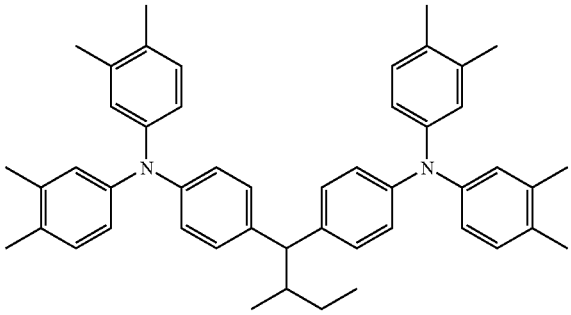

Comparative Example 12

A photoreceptor was produced in the same manner as in Example 18, except that the C.I. Solvent Orange 60 used in Example 18 was omitted.

Example 19

A photoreceptor was produced in the same manner as in Example 12, except that 70 parts by weight of PAR-1, 30 parts by weight of PCR-2, and 60 parts by weight of the charge transport material (CTM-8) having the structure shown below were used respectively in place of the polyarylate resin, polycarbonate resin, and charge transport material used in Example 12.

CTM-8

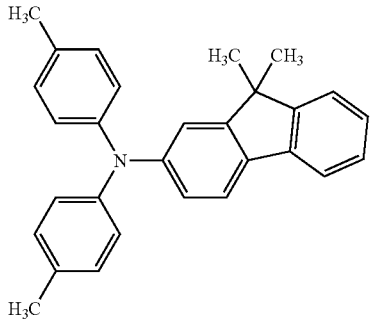

Comparative Example 13

A photoreceptor was produced in the same manner as in Example 19, except that the Compound (3)-13 used in Example 19 was omitted.

Example 20

A photoreceptor was produced in the same manner as in Example 19, except that 100 parts by weight of a polyarylate resin (PAR-6) having the structure shown below and Compound (1)-15 were used respectively in place of the binder resins and Compound (3)-13 used in Example 19, and that the polycarbonate resin was omitted.

Comparative Example 18

A photoreceptor was produced in the same manner as in Comparative Example 1, except that PCR-3 was used in place of the polyarylate resin used in Comparative Example 1.

Comparative Example 19

A photoreceptor was produced in the same manner as in Example 7, except that PCR-3 was used in place of the polyarylate resin used in Example 7.

PAR-6

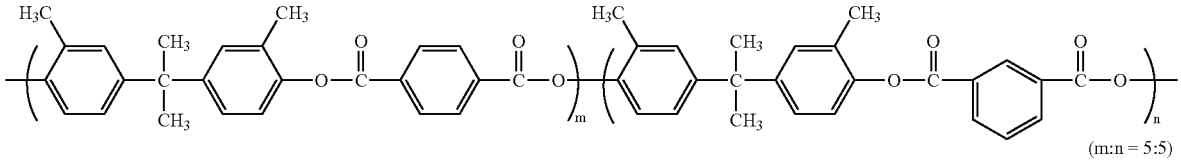

Comparative Example 14

A photoreceptor was produced in the same manner as in Example 20, except that the Compound (1)-15 used in Example 20 was omitted.

Comparative Example 15

A photoreceptor was produced in the same manner as in Example 1, except that a polycarbonate resin (PCR-3) having the structure shown below and CTM-2 were used, respectively, in place of the polyarylate resin and charge transport material used in Example 1.

Comparative Example 20

A photoreceptor was produced in the same manner as in Example 20, except that PCR-2 was used in place of the polyarylate resin used in Example 20.

Comparative Example 21

A photoreceptor was produced in the same manner as in Comparative Example 20, except that the Compound (1)-15 used in Comparative Example 20 was omitted.

PCR-3

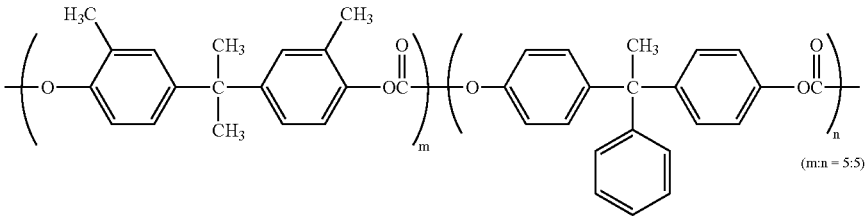

Comparative Example 16

A photoreceptor was produced in the same manner as in Comparative Example 15, except that the Compound (1)-15 used in Comparative Example 15 was omitted.

Comparative Example 17

A photoreceptor was produced in the same manner as in Comparative Example 15, except that Compound (3)-13 was used in place of the Compound (1)-15 used in Comparative Example 15.

Measurement of Absorption Spectrum

The light-absorbing compounds used in the Examples and Comparative Examples were dissolved in tetrahydrofuran in a concentration sufficient for each solution to have a maximum absorbance of 0.8–1.6 when examined in the range of 400–550 nm. Each solution was examined to obtain an absorption spectrum therefor, and the maximal absorption wavelength was determined. For the absorption spectrum examination, an ultraviolet/visible region spectrophotometer UV-1650PC, manufactured by Shimadzu Corp., and a solution cell made of quartz (cell dimension in the optical-path direction, 10 mm) were used. The results of the measurement are shown in Table 5 below.

TABLE 5

| Compound | Maximal absorption wavelength (nm) |
|---|---|
| (1)-15 | 431 |
| (3)-10 | 462 |
| (3)-22 | 474 |
| (3)-19 | 465 |
| (3)-13 | 469 |
| (1)-1 | 446 |
| C.I. Solvent Orange 60 | 446 |
| C.I. Solvent Red 117 | 520 |
| Compound A | 409 |
| Compound B | 416 |
| (5)-1 | 464 |
| (4)-17 | 451 |
| (4)-22 | 447 |

Electrical Properties of Photoreceptors

Each photoreceptor produced was bonded to a drum made of aluminum, and the drum made of aluminum and the vapor-deposited aluminum layer of the photoreceptor were electrically connected to each other. This drum was mounted on an apparatus for evaluating electrophotographic properties (described in *Zoku Denshishashin Gijutsu No Kiso To Ôyô, edited by The Society of Electrophotography, Corona Publishing Co., Ltd., pp.* 404–405) produced in accordance with the measurement standards of The Society of Electrophotography. The photoreceptor drum was evaluated for electrical properties in cycles each comprising charging, exposure, potential measurement, and erase.

First, the photoreceptor was charged so as to have an initial surface potential of −700 V. The light of a halogen lamp was converted to 780-nm monochromatic light with an interference filter and this light was used as an exposure light. Subsequently, the photoreceptor was exposed to the light at the exposure energy shown below and the resultant surface potential was measured.

In the case of each photoreceptor employing the oxytitanium phthalocyanine having the crystal form D, the surface potential VL was measured after the photoreceptor was irradiated with the exposure light in an amount of 0.2 $\mu J/cm^2$ and the time period from the exposure to potential measurement was set at 100 msec. In the case of each photoreceptor employing the oxytitanium phthalocyanine having the crystal form A, the surface potential VL was measured after the photoreceptor was irradiated with the exposure light in an amount of 0.44 $\mu J/cm^2$ and the time period from the exposure to potential measurement was set at 200 msec. As a light for erase was used a 660-nm LED light.

Subsequently, these photoreceptors were irradiated with the light of a white fluorescent lamp (Neolumi Super FL20SS•W/18, manufactured by Mitsubishi Electric Osram Ltd.) for 10 minutes after the light intensity as measured on the photoreceptor surface was adjusted to 2,000 lx. Thereafter, these photoreceptors were allowed to stand in the dark for 10 minutes and then subjected to the same examination.

In Tables 6 and 7 are shown electrophotographic-property changes ΔVO (change in initial surface potential) and ΔVL (change in exposed surface potential), which are changes in the initial surface potentials VO and VL of each photoreceptor through the illumination with the white fluorescent lamp. In Tables 6 and 7, each negative value indicates that the absolute value of the potential after the light irradiation was smaller than the absolute value of the potential before the light irradiation, while each positive value indicates that the absolute value after the light irradiation was larger. The smaller the absolute value of the change ΔVO or ΔVL, the smaller the change in the potential even with irradiation with a light having a high intensity. Smaller absolute values are hence preferred.

TABLE 6

| Photoreceptor | Change in initial surface potential (V) ΔVO | Change in exposed surface potential (V) ΔVL |
|---|---|---|
| Ex. 1 | −39 | −42 |
| Ex. 2 | −42 | −47 |
| Ex. 3 | −28 | −39 |
| Ex. 4 | −43 | −50 |
| Ex. 5 | −55 | −72 |
| Ex. 6 | −40 | −43 |
| Ex. 7 | −34 | −49 |
| Ex. 8 | −52 | −66 |
| Ex. 9 | −46 | −58 |
| Ex. 10 | −51 | −58 |
| Comp. Ex. 1 | −62 | −72 |
| Comp. Ex. 2 | −90 | −114 |
| Comp. Ex. 3 | −55 | −79 |
| Comp. Ex. 4 | −78 | −75 |

As shown in Table 6, the photoreceptors of the invention undergo a small potential change in each of VO and VL even through illumination with a white fluorescent lamp and have excellent resistance to exposure to intense light.

TABLE 7

| Photoreceptor | Change in initial surface potential (V) ΔVO | Change in exposed surface potential (V) ΔVL |
|---|---|---|
| Ex. 11 | −11 | −9 |
| Comp. Ex. 5 | −50 | −68 |
| Ex. 12 | −10 | −15 |
| Comp. Ex. 6 | −78 | −90 |
| Ex. 13 | −20 | −70 |
| Comp. Ex. 7 | −67 | −96 |
| Ex. 14 | −14 | −22 |
| Comp. Ex. 8 | −73 | −42 |
| Ex. 15 | −12 | −40 |
| Comp. Ex. 9 | −25 | −55 |
| Ex. 16 | −21 | −35 |
| Comp. Ex. 10 | −100 | −117 |
| Ex. 17 | −25 | −39 |
| Comp. Ex. 11 | −88 | −100 |
| Ex. 18 | −55 | −60 |
| Comp. Ex. 12 | −170 | −130 |
| Ex. 19 | −10 | −15 |
| Comp. Ex. 13 | −130 | −128 |
| Ex. 20 | −12 | −9 |
| Comp. Ex. 14 | −105 | −95 |

As shown in Table 7, the photoreceptors of the invention are highly effective in resistance to exposure to intense light even when various polyarylate resins and various charge transport materials are used therein.

Next, Table 8 shows differences in ΔVL value between the photoreceptors of Examples and the photoreceptors of Comparative Examples which have the same constitutions as the photoreceptors of the Examples except that the compound contained in the Examples which gives a tetrahydrofuran solution having at least one maximal absorbance value in the range of from 420 nm to 520 nm is not contained therein. In Table 8, Δref is a value obtained by subtracting the value of ΔVL for a Comparative Example from the value of ΔVL for the corresponding Example. The value of Δref indicates a change in ΔVL brought about due to the constitution characteristic of the photoreceptor of the invention. The larger the value of Δref, the higher the degree of improvement in resistance to exposure to intense light.

TABLE 8

| Photoreceptor | Binder resin | Charge-transporting material | Compound | Δref |
|---|---|---|---|---|
| Ex. 11 | PAR-2 | CTM-2 | (3)-13 | 59 |
| Comp. Ex. 5 | PAR-2 | CTM-2 | none | |
| Ex. 12 | PAR-3/PCR-1 | CTM-2 | (3)-13 | 75 |
| Comp. Ex. 6 | PAR-3/PCR-1 | CTM-2 | none | |
| Ex. 7 | PAR-1 | CTM-1 | (3)-13 | 23 |
| Comp. Ex. 1 | PAR-1 | CTM-1 | none | |
| Ex. 19 | PAR-1/PCR-2 | CTM-8 | (3)-13 | 113 |
| Comp. Ex. 13 | PAR-1/PCR-2 | CTM-8 | none | |
| Ex. 20 | PAR-6 | CTM-8 | (1)-15 | 86 |
| Comp. Ex. 14 | PAR-6 | CTM-8 | none | |
| Comp. Ex. 15 | PCR-3 | CTM-2 | (1)-15 | 6 |
| Comp. Ex. 17 | PCR-3 | CTM-2 | (3)-13 | 11 |
| Comp. Ex. 16 | PCR-3 | CTM-2 | none | |
| Comp. Ex. 19 | PCR-3 | CTM-1 | (3)-10 | 1 |
| Comp. Ex. 18 | PCR-3 | CTM-1 | none | |
| Comp. Ex. 20 | PCR-2 | CTM-8 | (1)-15 | 28 |
| Comp. Ex. 21 | PCR-2 | CTM-8 | none | |

As shown in Table 8, the photoreceptors containing a polyarylate resin, which is characteristic of the invention, are improved in a higher degree in the electrical-property change through illumination with the white fluorescent lamp by the incorporation of a light-absorbing compound according to the invention into the photosensitive layer, as compared with the photoreceptors of Comparative Examples which contain no polyarylate resin. It can hence be seen that the incorporation is significantly effective in the improvement.

Ozone Exposure Test

The method for the ozone exposure test is described below. First, a photoreceptor which had not undergone exposure to ozone was evaluated for initial electrical properties with EPA-8200, manufactured by Kawaguchi Electric Works Co., Ltd., in the static mode. A corotron charging device was used to charge the photoreceptor at a current value of 30 μA. This photoreceptor was then exposed to 140–200 ppm ozone for 3–5 hours per day for 2 days so as to result in an integrated ozone exposure amount of 1,120 ppm·hr. Thereafter, the photoreceptor was evaluated for electrical properties again. The proportion of the initial surface potential VO as measured after the ozone exposure to the VO before the exposure is shown in Table 9.

TABLE 9

| Photoreceptor | VO after ozone exposure/VO before ozone exposure (%) |
|---|---|
| Example 1 | 86.8 |
| Example 4 | 97.5 |
| Example 7 | 96.4 |
| Comparative Example 1 | 78.4 |
| Comparative Example 4 | 80.9 |

It is evident from the above that the photoreceptors of Example 1, Example 4, and Example 7, which contain an azo compound represented by formula (1) or formula (2), undergo only a slight change in initial surface potential VO through ozone exposure and show highly excellent performance.

Production of Electrophotographic Photoreceptor Drum

Example 21

The coating fluid for charge generation layer formation prepared in Example 1 was applied by dip coating on an aluminum tube which had a diameter of 30 mm and a length of 340 mm and the surface of which had undergone anodization and a sealing treatment with nickel ion (i.e., nickel acetate). Thus, a charge generation layer having a thickness of 0.4 μm was formed.

A coating fluid for charge transport layer formation obtained by mixing 5 parts by weight of Compound (1)-15, 50 parts by weight of PAR-1, 50 parts by weight of PCR-2, 50 parts by weight of CTM-2, 8 parts by weight of the hindered phenol compound shown below, 0.05 parts by weight of a silicone oil (Shin-Etsu Silicone KF96), 100 parts by weight of toluene, and 400 parts by weight of tetrahydrofuran was applied on the charge generation layer by dip coating in such an amount as to result in a thickness after drying of 25 μm to thereby form a charge transport layer. Thus, an electrophotographic photoreceptor drum was produced.

Hindered Phenol Compound

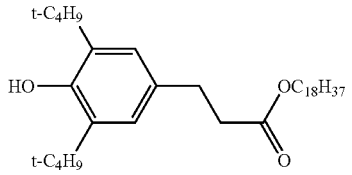

Example 22

Using an aluminum tube which had a diameter of 30 mm and a length of 351 mm and had undergone an anodizing treatment and a nickel sealing treatment, a photoreceptor was produced in the same manner as in Example 21, except that 2 parts by weight of Compound (3)-13 was used in place of 5 parts by weight of the Compound (1)-15 used in Example 21 and that the thickness of the charge transport layer was changed to 18 μm.

Comparative Example 22

A photoreceptor was produced in the same manner as in Example 21, except that the Compound (1)-15 used in Example 21 was omitted.

Comparative Example 23

A photoreceptor was produced in the same manner as in Example 22, except that the Compound (3)-13 used in Example 22 was omitted.

Image Evaluation

The photoreceptors produced in Example 21 and Comparative Example 22 were partly covered with black paper for light shielding and irradiated with 1,000-lx white light for 10 minutes or 30 minutes. Each photoreceptor drum which had been thus exposed to white light was mounted in a black drum cartridge for tandem color laser printer SPEEDIA N5, manufactured by CASIO, and a half-tone image was printed in the monochromatic printing mode.

Thereafter, the half-tone image corresponding to the light-shielded part was compared in image density with that corresponding to the light-irradiated part. The results of the evaluation are shown in Table 10.

TABLE 10

| Photoreceptor | Difference in density between light-shielded part and light-irradiated part | |
|---|---|---|
| | Photoreceptor after 10-minute exposure | Photoreceptor after 30-minute exposure |
| Example 21 | nil | nil |
| Comparative Example 22 | slight difference (light-irradiated part had increased density) | Difference (light-irradiated part had increased density) |

The photoreceptors produced in Example 22 and Comparative Example 23 were partly covered with black paper for light shielding and irradiated with 1,000-lx white light for 10 minutes or 30 minutes. Each photoreceptor drum which had been thus exposed to white light was mounted in a black drum cartridge for tandem color laser printer Microline 3050c, manufactured by Oki Data Corp., and a half-tone image was printed in the monochromatic printing mode. Thereafter, the half-tone image corresponding to the light-shielded part was compared in image density with that corresponding to the light-irradiated part. The results of the evaluation are shown in Table 11.

TABLE 11

| Photoreceptor | Difference in density between light-shielded part and light-irradiated part | |
|---|---|---|
| | Photoreceptor after 10-minute exposure | Photoreceptor after 30-minute exposure |
| Example 22 | nil | nil |
| Comparative Example 23 | slight difference (light-irradiated part had increased density) | Difference (light-irradiated part had increased density) |

The photoreceptors of the invention were found to undergo no influence even when irradiated with intense white light and give satisfactory images.

Abrasion Test

A photoreceptor film in a sheet form was cut into a disk shape having a diameter of 10 cm and evaluated for abrasion with a Taber abrasion tester (manufactured by Toyo Seiki Ltd.). The test conditions are as follows. The test was conducted using abrading wheel CS-10F in an atmosphere having a temperature of 23° C. and a relative humidity of 50%. The abrading wheel was rotated under no load (with the own weight of the wheel) so as to make 1,000 revolutions. Thereafter, the abrasion wear was determined by comparing the weight before the test with the weight after the test. The photoreceptors used are shown below.

Photoreceptor T1

A sheet-form photoreceptor produced in the same manner as in Example 1.

Photoreceptor T2

A sheet-form photoreceptor produced in the same manner as in Example 1, except that polycarbonate resin PCR-3 was used in place of the polyarylate resin PAR-1 used in Example 1.

Photoreceptor T3

A sheet-form photoreceptor produced in the same manner as for photoreceptor T2, except that CTM-3 was used in place of the charge transport material CTM-1 used in Photoreceptor T2.

The results of the abrasion test of Photoreceptors T1, T2, and T3 are shown in Table 12 below.

TABLE 12

| Photoreceptor | Taber abrasion wear (mg) |
|---|---|
| T1 | 3.3 |
| T2 | 7.1 |
| T3 | 5.3 |

It is evident from the abrasion test results given in Table 12 that the photoreceptor of the invention has highly excellent wearing resistance.

The electrophotographic photoreceptor according to the present invention is highly satisfactory in light resistance and ozone resistance. It is hence an excellent photoreceptor which is very easy to handle. The photoreceptor is exceedingly effective especially when a polyarylate resin weakly functioning as an acceptor is used as a binder in the charge transport layer.

Polyarylate resins are apt to form a weak charge-transfer complex with a charge transport material, which is electron-donative. Since such a complex generally has an electron conjugation system having a spread structure, it expands the light-absorption wavelength range. As a result, this charge transport layer is more apt to be influenced by exposure to light. Furthermore, due to the change in electron structure described above, the layer is apt to be simultaneously susceptible to oxidation by oxidizing gases represented by ozone gas. The photoreceptor of the invention undergoes almost no accumulation of residual potential even in repetitions of use and fluctuates little in charge potential and sensitivity. Since the photoreceptor has exceedingly satisfactory stability, it has excellent durability. Consequently, the photoreceptor can be advantageously used in high-speed copiers, color printers, etc.

In addition, the image-forming apparatus and drum cartridge each employing the photoreceptor according to the invention do not necessitate a special measure for light shielding and can be easily handled.

Numerous modifications and variations on the present invention are possible in light of the above teachings. It is, therefore, to be understood that within the scope of the accompanying claims, the invention may be practiced otherwise than as specifically described herein.

The invention claimed is:

1. An electrophotographic photoreceptor comprising an electroconductive substrate and having provided thereon at least a photosensitive layer comprising a charge generation material, a charge transport material, and a binder resin, wherein a polyarylate resin is selected as the binder resin and the photosensitive layer and/or a layer formed on the outer side of the layer contains a light-absorbing compound which is a compound whose absorbance (value for a tetrahydrofuran solution thereof) in the range of from 420 nm to 520 nm has at least one maximal absorbance value and which has compatibility with the layer containing the compound, and wherein said charge generation material is photoconductive material selected from the group consisting of an inorganic photoconductive material and an organic photoconductive material, wherein said inorganic photoconductive material is selected from the group consisting of selenium, alloys of selenium, and amorphous silicon, wherein said organic photoconductive material is selected from the group consisting of phthalocyanine pigments, guinacridone pigments, indigo pigments, perylene pigments, polycyclic quinone pigments, anthanthrone pigments, and benzimidazole pigments, with the proviso that where said photoconductive material is an organic photoconductive material and said organic photoconductive material is a phthalocyanine pigment, said phthalocyanine pigment is a metal-bound phthalocyanine pigment, with the further proviso that when said metal-bound phthalocyanine pigment is a titanyl phthalocyanine, said titanyl phthalocyanine is crystalline.

2. The electrophotographic photoreceptor according to claim 1, wherein the percentage change in charge potential of the electrophotographic photoreceptor through exposure to 1,100±200 (ppm·hr) ozone is 15% or less.

3. The electrophotographic photoreceptor according to claim 1, wherein the light-absorbing compound is an azo compound.

4. The electrophotographic photoreceptor according to claim 3, wherein the azo compound is a monoazo compound represented by the following formula (1)

$$A^1\text{-}N{=}N{-}B^1 \quad (1)$$

wherein $A^1$ and $B^1$ independently represent an aryl group which may have one or more substituents.

5. The electrophotographic photoreceptor according to claim 3, wherein the azo compound is a monoazo compound represented by the following formula (2)

$$A^2\text{-}N{=}N{-}B^2 \quad (2)$$

wherein $A^2$ represents an aryl group which may have one or more substituents, and $B^2$ is a group represented by the following formula (3), (4), or (5)

(3)

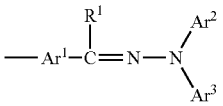

(4)

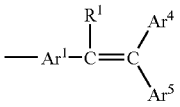

-continued (5)

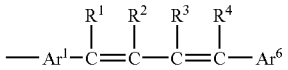

wherein $Ar^1$ represents an arylene group which may have one or more substituents, and $Ar^2$, $Ar^3$, and $Ar^6$ represent an alkyl group which may have one or more substituents or an aryl group which may have one or more substituents, $Ar^4$, $Ar^5$, and $R^4$ each independently represent a hydrogen atom, an alkyl group which may have one or more substituents, or an aryl group which may have one or more substituents, and $R^1$, $R^2$, and $R^3$ represent a hydrogen atom or an alkyl group which may have one or more substituents.

6. The electrophotographic photoreceptor according to claim 5, wherein $A^2$ is a phenyl group.

7. The electrophotographic photoreceptor according to claim 6, wherein $Ar^1$ is a pheylene group and $Ar^2$, $Ar^3$, and $Ar^6$ represent an aryl group which may have one or more substituents.

8. The electrophotographic photoreceptor according to claim 1, wherein the light-absorbing compound is contained in an amount of 0.1–30 parts by weight per 100 parts by weight of the binder resin which binds the layer containing the compound.

9. The electrophotographic photoreceptor according to claim 1, wherein the polyarylate resin has repeating structures represented by the following formula (6)

(6)

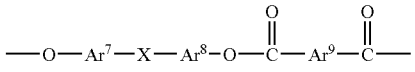

wherein $Ar^7$, $Ar^8$, and $Ar^9$ each independently represent an arylene group which may have one or more substituents, and X represents a direct bond between $Ar^7$ and $Ar^8$ or a divalent connecting group.

10. The electrophotographic photoreceptor according to claim 1, wherein the polyarylate resin has a viscosity-average molecular weight of from 10,000 to 300,000.

11. The electrophotographic photoreceptor according to claim 1, wherein said charge transport material is a compound represented by the following formula (7)

(7)

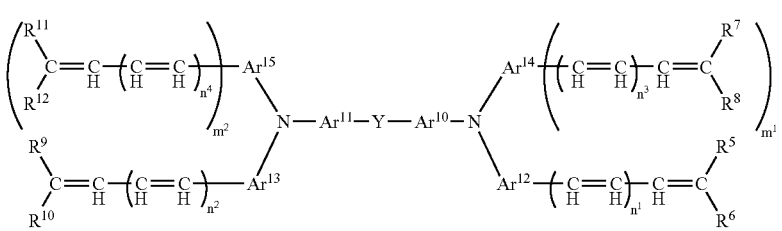

wherein $Ar^{10}$ to $Ar^{15}$ each independently represents an arylene group which may have one or more substituents or a divalent heterocyclic group which may have one or more substituents, $m^1$ and $m^2$ each independently represents 0 or 1, wherein $Ar^{14}$ when $m^1=0$ and $Ar^{15}$ when $m^2=0$ each represents an aryl group which may have one or more substituents, or a monovalent heterocyclic group which may have one or more substituents; and wherein $Ar^{14}$ when $m^1=1$ and $Ar^{15}$ when $m^2=1$ each represents an arylene group which may have one or more substituents, or a divalent heterocyclic group which may have one or more substituents, Y represents a direct bond between $Ar^{10}$ and $Ar^{11}$ or a divalent connecting group, $R^5$ to $R^{12}$ each independently represents a hydrogen atom, an alkyl group which may have one or more substituents, an aryl group which may have one or more substituents, or a heterocyclic group which may have one or more substituents, $n^1$ to $n^4$ each independently represents an integer of 0 to 4, and at least two of $Ar^{10}$ to $Ar^{15}$ may be bonded to each other to form a ring structure.

12. The electrophotographic photoreceptor according to claim 1, wherein said charge transport material is a compound represented by the following formula (8)

(8)

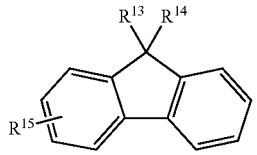

wherein $R^{13}$ and $R^{14}$ represent an alkyl group which may have one or more substituents or a hydrogen atom, and $R^{15}$ represents a diarylamino group which may have one or more substituents.

13. The electrophotographic photoreceptor according to claim 1, wherein said charge transport material is a compound represented by the following formula (9)

(9)

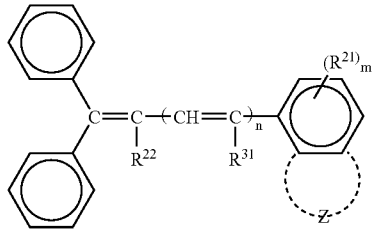

wherein $R^{21}$ is selected from the group consisting of a hydrogen atom, an alkyl group, an alkoxy group, a halogen atom and a substituted amino group (—$NR^{23}R^{24}$), wherein $R^{23}$ and $R^{24}$ each independently represent an alkyl group, an aralkyl group which may have one or more substituents, or an aryl group which may have one or more substituents, or $R^{23}$ and $R^{24}$ may be connected to form a cyclic structure, $R^{22}$ is selected from the group consisting of a hydrogen atom, an alkyl group, and a phenyl group which may have one or more substituents, $R^{31}$ is a hydrogen atom, an alkyl group which may have one or more substituents, or an aryl group which may have one or more substituents, Z is either not present or represents a structure selected from the group consisting of a benzene structure, a naphthalene structure, and an indole structure, wherein said structure may have one or more substituents, n represents an integer selected from the group consisting of 0 and 1, and m represents an integer selected from the group consisting of 0, 1, 2, and 3.

14. The electrophotographic photoreceptor according to claim 13, wherein $R^{31}$ is a hydrogen atom.

15. The electrophotographic photoreceptor according to claim 1, wherein said charge transport material is a compound represented by the following formula (10)

(10)

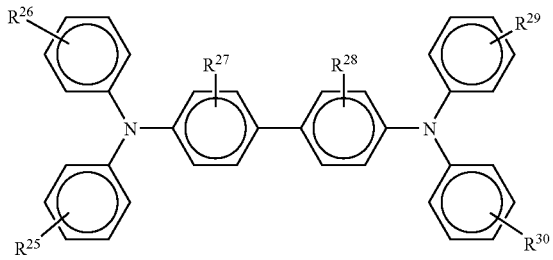

wherein $R^{25}$ to $R^{30}$ each independently represents a hydrogen atom, an alkyl group, an alkoxy group, an aryl group or a halogen atom.

16. The electrophotographic photoreceptor according to claim 15, wherein $R^{26}$–$R^{29}$ is a hydrogen atom and $R^{25}$ and $R^{30}$ are independently selected from the group consisting of o-$CH_3$, m-$CH_3$, p-$CH_3$, o-Cl, m-Cl, and p-Cl.

17. The electrophotographic photoreceptor according to claim 1, wherein said charge generation material is an organic photoconductive material and said organic photoconductive material is metal-bound phthalocyanine pigment.

18. The electrophotographic photoreceptor according to claim 17, wherein said metal coordinated to said phthalocyanine pigment is selected from the group consisting of copper, indium, gallium, tin, zinc, vanadium, silicon, and germanium.

19. The electrophotographic photoreceptor according to claim 18, wherein said metal is in a form selected from the group consisting of an oxide, a halide, a hydroxide, and an alkoxide.

20. The electrophotographic photoreceptor according to claim 1, wherein said charge generation material is an organic photoconductive material and said organic photoconductive material is a crystalline titanyl phthalocyanine.

21. The electrophotographic photoreceptor according to claim 20, wherein said crystalline titanyl phthalocyanine is in a crystal form selected from the group consisting of A-form, B-form, and D-form.

22. An electrophotographic apparatus comprising the electrophotographic photoreceptor according to claim 1.

23. A cartridge for electrophotographic apparatus, comprising the electrophotographic photoreceptor according to claim 1.

24. An electrophotographic photoreceptor comprising an electroconductive substrate and having provided thereon at least a photosensitive layer comprising a charge generation material, a charge transport material, and a binder resin, wherein a polyarylate resin is selected as the binder resin and that the photosensitive layer and/or a layer formed on the outer side of the layer contains a monoazo compound which has compatibility with the layer and is represented by the following formula (1)

$$A^1\text{-}N{=}N{-}B^1 \quad (1)$$

wherein $A^1$ and $B^1$ independently represent an aryl group which may have one or more substituents, and wherein said charge generation material is photoconductive material selected from the group consisting of an inorganic photoconductive material and an organic photoconductive material, wherein said inorganic photoconductive material is selected from the group consisting of selenium, alloys of selenium, and amorphous silicon, wherein said organic photoconductive material is selected from the group consisting of phthalocyanine pigments, quinacridone pigments, indigo pigments, perylene pigments, polycyclic quinone pigments, anthanthrone pigments, and benzimidazole pigments, with the proviso that where said photoconductive material is an organic photoconductive material and said organic photoconductive material is a phthalocyanine pigment, said phthalocyanine pigment is a metal-bound phthalocyanine pigment, with the further proviso that when said metal-bound phthalocyanine pigment is a titanyl phthalocyanine, said titanyl phthalocyanine is crystalline.

25. The electrophotographic photoreceptor according to claim 24, wherein said charge generation material is an organic photoconductive material and said organic photoconductive material is metal-bound phthalocyanine pigment.

26. The electrophotographic photoreceptor according to claim 25, wherein said metal coordinated to said phthalocyanine pigment is selected from the group consisting of copper, indium, gallium, tin, zinc, vanadium, silicon, and germanium.

27. The electrophotographic photoreceptor according to claim 26, wherein said metal is in a form selected from the group consisting of an oxide, a halide, a hydroxide, and an alkoxide.

28. The electrophotographic photoreceptor according to claim 24, wherein said charge generation material is an organic photoconductive material and said organic photoconductive material is a crystalline titanyl phthalocyanine.

29. The electrophotographic photoreceptor according to claim 28, wherein said crystalline titanyl phthalocyanine is in a crystal form selected from the group consisting of A-form, B-form, and D-form.

30. An electrophotographic photoreceptor comprising an electroconductive substrate and having provided thereon at least a photosensitive layer comprising a charge generation material, a charge transport material, and a binder resin, wherein a polyarylate resin is selected as the binder resin and that the photosensitive layer and/or a layer formed on the outer side of the layer contains a monoazo compound which has compatibility with the layer and is represented by the following formula (2)

$$A^2\text{-}N{=}N{-}B^2 \quad (2)$$

wherein $A^2$ represents an aryl group which may have one or more substituents, and $B^2$ is a group represented by the following formula (3), (4), or (5)

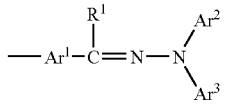

(3)

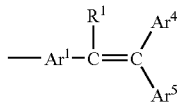

(4)

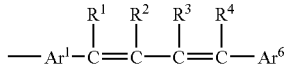

(5)

wherein $Ar^1$ represents an arylene group which may have one or more substituents, and $Ar^2$, $Ar^3$, and $Ar^6$ represent an alkyl group which may have one or more substituents or an aryl group which may have one or more substituents, $Ar^4$, $Ar^5$, and $R^4$ each independently represent a hydrogen atom, an alkyl group which may have one or more substituents, or an aryl group which may have one or more substituents, and $R^1$, $R^2$, and $R^3$ represent a hydrogen atom or an alkyl group which may have one or more substituents, and wherein said charge generation material is photoconductive material selected from the group consisting of an inorganic photoconductive material and an organic photoconductive material, with the proviso that where said photoconductive material is an organic photoconductive material and said organic photoconductive material is a phthalocyanine pigment, said phthalocyanine pigment is a metal-bound phthalocyanine pigment, with the further proviso that when said metal-bound phthalocyanine pigment is a titanyl phthalocyanine, said titanyl phthalocyanine is crystalline.

31. The electrophotographic photoreceptor according to claim 30, wherein $A^2$ is a phenyl group.

32. The electrophotographic photoreceptor according to claim 31, wherein $Ar^1$ is a pheylene group and $Ar^2$, $Ar^3$, and $Ar^6$ represent an aryl group which may have one or more substituents.

33. The electrophotographic photoreceptor according to claim 30, wherein said charge generation material is an inorganic photoconductive material and said inorganic photoconductive material is selected from the group consisting of selenium, a selenium alloy, and amorphous silicon.

34. The electrophotographic photoreceptor according to claim 30, wherein said charge generation material is an organic photoconductive material and said organic photoconductive material is selected from the group consisting of an azo pigment, a quinacridone pigment, an indigo pigment, a perylene pigment, a polycyclic quinone pigment, an anthanthrone pigment, and a benzimidazole pigment.

35. The electrophotographic photoreceptor according to claim 30, wherein said charge generation material is an organic photoconductive material and said organic photoconductive material is metal-bound phthalocyanine pigment.

36. The electrophotographic photoreceptor according to claim 35, wherein said metal coordinated to said phthalocyanine pigment is selected from the group consisting of copper, indium, gallium, tin, zinc, vanadium, silicon, and germanium.

37. The electrophotographic photoreceptor according to claim 36, wherein said metal is in a form selected from the group consisting of an oxide, a halide, a hydroxide, and an alkoxide.

38. The electrophotographic photoreceptor according to claim 30, wherein said charge generation material is an organic photoconductive material and said organic photoconductive material is a crystalline titanyl phthalocyanine.

39. The electrophotographic photoreceptor according to claim 38, wherein said crystalline titanyl phthalocyanine is in a crystal form selected from the group consisting of A-form, B-form, and D-form.

40. An electrophotographic photoreceptor comprising an electroconductive substrate and having provided thereon at least a photosensitive layer comprising a charge generation material, a charge transport material, and a binder resin, wherein a polyarylate resin is selected as the binder resin and the photosensitive layer and/or a layer formed on the outer side of the layer contains a light-absorbing compound which is a compound whose absorbance (value for a tetrahydrofuran solution thereof) in the range of from 420 nm to 520 nm has at least one maximal absorbance value and which has compatibility with the layer containing the compound, and wherein said charge transport material is a compound represented by the following formula (7)

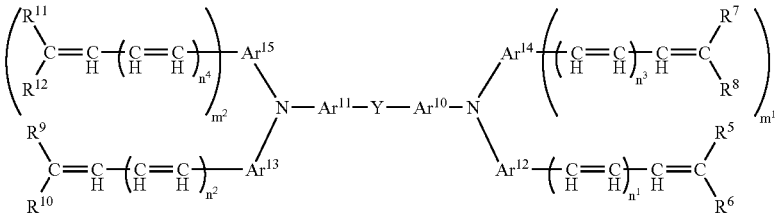

(7)

wherein $Ar^{10}$ to $Ar^{15}$ each independently represents an arylene group which may have one or more substituents or a divalent heterocyclic group which may have one or more substituents, $m^1$ and $m^2$ each independently represents 0 or 1, wherein $Ar^{14}$ when $m^1=0$ and $Ar^{15}$ when $m^2=0$ each represents an aryl group which may have one or more substituents, or a monovalent heterocyclic group which may have one or more substituents; and wherein $Ar^{14}$ when $m^1=1$ and $Ar^{15}$ when $m^2=1$ each represents an arylene group which may have one or more substituents, or a divalent heterocyclic group which may have one or more substituents, Y represents a direct bond between $Ar^{10}$ and $Ar^{11}$ or a divalent connecting group, $R^5$ to $R^{12}$ each independently represents a hydrogen atom, an alkyl group which may have one or more substituents, an aryl group which may have one or more substituents, or a heterocyclic group which may have one or more substituents, $n^1$ to $n^4$ each independently represents an integer of 0 to 4, and at least two of $Ar^{10}$ to $Ar^{15}$ may be bonded to each other to form a ring structure.

41. The electrophotographic photoreceptor according to claim 40, wherein the light-absorbing compound is an azo compound.

42. The electrophotographic photoreceptor according to claim 41, wherein the azo compound is a monoazo compound represented by the following formula (1)

$$A^1\text{-N=N—}B^1 \quad (1)$$

wherein $A^1$ and $B^1$ independently represent an aryl group which may have one or more substituents.

43. The electrophotographic photoreceptor according to claim 41, wherein the azo compound is a monoazo compound represented by the following formula (2)

$$A^2\text{-N=N—}B^2 \quad (2)$$

wherein $A^2$ represents a phenyl group which may have one or more substituents, and $B^2$ is a group represented by the following formula (3), (4), or (5)

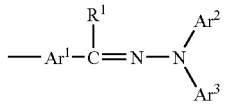

(3)

-continued

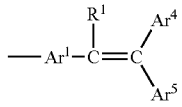

(4)

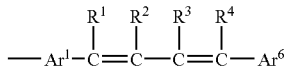

(5)

wherein $Ar^1$ represents an arylene group which may have one or more substituents, and $Ar^2$, $Ar^3$, and $Ar^6$ represent an alkyl group which may have one or more substituents or an aryl group which may have one or more substituents, $Ar^4$, $Ar^5$, and $R^4$ each independently represent a hydrogen atom, an alkyl group which may have one or more substituents, or an aryl group which may have one or more substituents, and $R^1$, $R^2$, and $R^3$ represent a hydrogen atom or an alkyl group which may have one or more substituents.

44. The electrophotographic photoreceptor according to claim 43, wherein $A^2$ is a phenyl group.

45. The electrophotographic photoreceptor according to claim 44, wherein $Ar^1$ is a pheylene group and $Ar^2$, $Ar^3$, and $Ar^6$ represent an aryl group which may have one or more substituents.

46. The electrophotographic photoreceptor according to claim 40, wherein the light-absorbing compound is contained in an amount of 0.1–30 parts by weight per 100 parts by weight of the binder resin which binds the layer containing the compound.

47. The electrophotographic photoreceptor according to claim 40, wherein the polyarylate resin has repeating structures represented by the following formula (6)

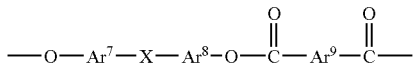

(6)

wherein $Ar^7$, $Ar^8$, and $Ar^9$ each independently represent an arylene group which may have one or more substituents, and X represents a direct bond between $Ar^7$ and $Ar^8$ or a divalent connecting group.

48. An electrophotographic photoreceptor comprising an electroconductive substrate and having provided thereon at least a photosensitive layer comprising a charge generation material, a charge transport material, and a binder resin, wherein a polyarylate resin is selected as the binder resin and the photosensitive layer and/or a layer formed on the outer side of the layer contains a light-absorbing compound which is a compound whose absorbance (value for a tetrahydrofuran solution thereof) in the range of from 420 nm to 520 nm has at least one maximal absorbance value and which has compatibility with the layer containing the compound, and wherein said charge transport material is a compound represented by the following formula (8)

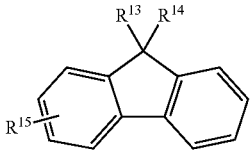

(8)

wherein $R^{13}$ and $R^{14}$ represent an alkyl group which may have one or more substituents or a hydrogen atom, and $R^{15}$ represents a diarylamino group which may have one or more substituents.

49. The electrophotographic photoreceptor according to claim 48, wherein the light-absorbing compound is an azo compound.

50. The electrophotographic photoreceptor according to claim 49, wherein the azo compound is a monoazo compound represented by the following formula (1)

$$A^1\text{-}N{=}N{-}B^1 \quad (1)$$

wherein $A^1$ and $B^1$ independently represent an aryl group which may have one or more substituents.

51. The electrophotographic photoreceptor according to claim 50, wherein the azo compound is a monoazo compound represented by the following formula (2)

$$A^2\text{-}N{=}N{-}B^2 \quad (2)$$

wherein $A^2$ represents an aryl group which may have one or more substituents, and $B^2$ is a group represented by the following formula (3), (4), or (5)

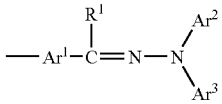

(3)

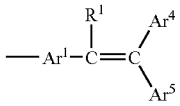

(4)

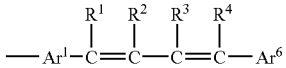

(5)

wherein $Ar^1$ represents an arylene group which may have one or more substituents, and $Ar^2$, $Ar^3$, and $Ar^6$ represent an alkyl group which may have one or more substituents or an aryl group which may have one or more substituents, $Ar^4$, $Ar^5$, and $R^4$ each independently represent a hydrogen atom, an alkyl group which may have one or more substituents, or an aryl group which may have one or more substituents, and $R^1$, $R^2$, and $R^3$ represent a hydrogen atom or an alkyl group which may have one or more substituents.

52. The electrophotographic photoreceptor according to claim 51, wherein $A^2$ is a phenyl group.

53. The electrophotographic photoreceptor according to claim 52, wherein $Ar^1$ is a pheylene group and $Ar^2$, $Ar^3$, and $Ar^6$ represent an aryl group which may have one or more substituents.

54. The electrophotographic photoreceptor according to claim 48, wherein the light-absorbing compound is contained in an amount of 0.1–30 parts by weight per 100 parts by weight of the binder resin which binds the layer containing the compound.

55. The electrophotographic photoreceptor according to claim 48, wherein the polyarylate resin has repeating structures represented by the following formula (6)

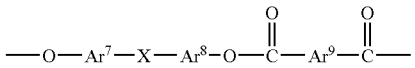

(6)

wherein $Ar^7$, $Ar^8$, and $Ar^9$ each independently represent an arylene group which may have one or more substituents, and X represents a direct bond between $Ar^7$ and $Ar^8$ or a divalent connecting group.

56. An electrophotographic photoreceptor comprising an electroconductive substrate and having provided thereon at least a photosensitive layer comprising a charge generation material, a charge transport material, and a binder resin, wherein a polyarylate resin is selected as the binder resin and the photosensitive layer and/or a layer formed on the outer side of the layer contains a light-absorbing compound which is a compound whose absorbance (value for a tetrahydrofuran solution thereof) in the range of from 420 nm to 520 nm has at least one maximal absorbance value and which has compatibility with the layer containing the compound, and wherein said charge transport material is a compound represented by the following formula (9)

(9)

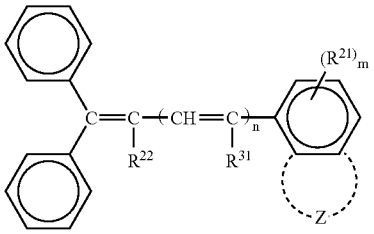

wherein $R^{21}$ is selected from the group consisting of a hydrogen atom, an alkyl group, an alkoxy group, a halogen atom and a substituted amino group (—$NR^{23}R^{24}$), wherein $R^{23}$ and $R^{24}$ each independently represent an alkyl group, an aralkyl group which may have one or more substituents, or an aryl group which may have one or more substituents, or $R^{23}$ and $R^{24}$ may be connected to form a cyclic structure, $R^{22}$ is selected from the group consisting of a hydrogen atom, an alkyl group, and a phenyl group which may have one or more substituents, $R^{31}$ is a hydrogen atom, an alkyl group which may have one or more substituents, or an aryl group which may have one or more substituents, Z is either not present or represents a structure selected from the group consisting of a benzene structure, a naphthalene structure, and an indole structure, wherein said structure may have one or more substituents, n represents an integer selected from the group consisting of 0 and 1, and m represents an integer selected from the group consisting of 0, 1, 2, and 3.

57. The electrophotographic photoreceptor according to claim 56, wherein $R^{31}$ is a hydrogen atom.

58. The electrophotographic photoreceptor according to claim 56, wherein the light-absorbing compound is an azo compound.

59. The electrophotographic photoreceptor according to claim 58, wherein the azo compound is a monoazo compound represented by the following formula (1)

$$A^1\text{-}N{=}N{-}B^1 \quad (1)$$

wherein $A^1$ and $B^1$ independently represent an aryl group which may have one or more substituents.

60. The electrophotographic photoreceptor according to claim 58, wherein the azo compound is a monoazo compound represented by the following formula (2)

$$A^2\text{-}N{=}N{-}B^2 \quad (2)$$

wherein $A^2$ represents an aryl group which may have one or more substituents, and $B^2$ is a group represented by the following formula (3), (4), or (5)

(3)

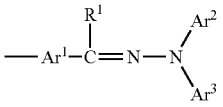

-continued (4)

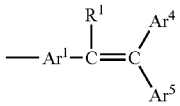

(5)

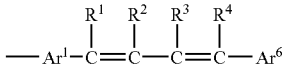

wherein $Ar^1$ represents an arylene group which may have one or more substituents, and $Ar^2$, $Ar^3$, and $Ar^6$ represent an alkyl group which may have one or more substituents or an aryl group which may have one or more substituents, $Ar^4$, $Ar^5$, and $R^4$ each independently represent a hydrogen atom, an alkyl group which may have one or more substituents, or an aryl group which may have one or more substituents, and $R^1$, $R^2$, and $R^3$ represent a hydrogen atom or an alkyl group which may have one or more substituents.

61. The electrophotographic photoreceptor according to claim 60, wherein $A^2$ is a phenyl group.

62. The electrophotographic photoreceptor according to claim 61, wherein $Ar^1$ is a pheylene group and $Ar^2$, $Ar^3$, and $Ar^6$ represent an aryl group which may have one or more substituents.

63. The electrophotographic photoreceptor according to claim 56, wherein the light-absorbing compound is contained in an amount of 0.1–30 parts by weight per 100 parts by weight of the binder resin which binds the layer containing the compound.

64. The electrophotographic photoreceptor according to claim 56, wherein the polyarylate resin has repeating structures represented by the following formula (6)

(6)

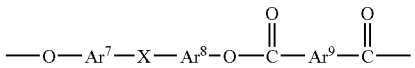

wherein $Ar^7$, $Ar^8$, and $Ar^9$ each independently represent an arylene group which may have one or more substituents, and X represents a direct bond between $Ar^7$ and $Ar^8$ or a divalent connecting group.

65. An electrophotographic photoreceptor comprising an electroconductive substrate and having provided thereon at least a photosensitive layer comprising a charge generation material, a charge transport material, and a binder resin, wherein a polyarylate resin is selected as the binder resin and the photosensitive layer and/or a layer formed on the outer side of the layer contains a light-absorbing compound which is a compound whose absorbance (value for a tetrahydrofuran solution thereof) in the range of from 420 nm to 520 nm has at least one maximal absorbance value and which has compatibility with the layer containing the compound, and wherein said charge transport material is a compound represented by the following formula (10)

(10)

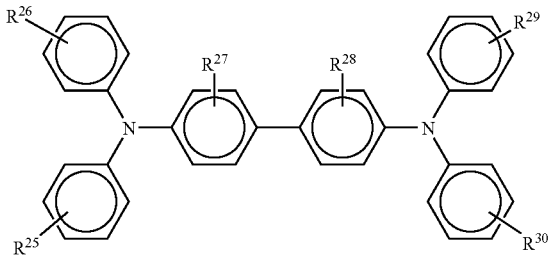

wherein $R^{25}$ to $R^{30}$ each independently represents a hydrogen atom, an alkyl group, an alkoxy group, an aryl group or a halogen atom.

66. The electrophotographic photoreceptor according to claim 65, wherein $R^{26}$–$R^{29}$ is a hydrogen atom and $R^{25}$ and $R^{30}$ are independently selected from the group consisting of o-$CH_3$, m-$CH_3$, p-$CH_3$, o-Cl, m-Cl, and p-Cl.

67. The electrophotographic photoreceptor according to claim 65, wherein the light-absorbing compound is an azo compound.

68. The electrophotographic photoreceptor according to claim 67, wherein the azo compound is a monoazo compound represented by the following formula (1)

$$A^1\text{-}N{=}N{-}B^1 \quad (1)$$

wherein $A^1$ and $B^1$ independently represent an aryl group which may have one or more substituents.

69. The electrophotographic photoreceptor according to claim 67, wherein the azo compound is a monoazo compound represented by the following formula (2)

$$A^2\text{-}N{=}N{-}B^2 \quad (2)$$

wherein $A^2$ represents an aryl group which may have one or more substituents, and $B^2$ is a group represented by the following formula (3), (4), or (5)

(3)

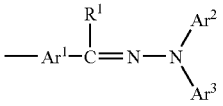

-continued (4)

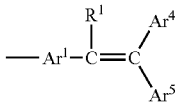

(5)

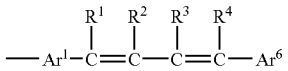

wherein $Ar^1$ represents an arylene group which may have one or more substituents, and $Ar^2$, $Ar^3$, and $Ar^6$ represent an alkyl group which may have one or more substituents or an aryl group which may have one or more substituents, $Ar^4$, $Ar^5$, and $R^4$ each independently represent a hydrogen atom, an alkyl group which may have one or more substituents, or an aryl group which may have one or more substituents, and $R^1$, $R^2$, and $R^3$ represent a hydrogen atom or an alkyl group which may have one or more substituents.

70. The electrophotographic photoreceptor according to claim 69, wherein $A^2$ is a phenyl group.

71. The electrophotographic photoreceptor according to claim 69, wherein $Ar^1$ is a pheylene group and $Ar^2$, $Ar^3$, and $Ar^6$ represent an aryl group which may have one or more substituents.

72. The electrophotographic photoreceptor according to claim 65, wherein the light-absorbing compound is contained in an amount of 0.1–30 parts by weight per 100 parts by weight of the binder resin which binds the layer containing the compound.

73. The electrophotographic photoreceptor according to claim 65, wherein the polyarylate resin has repeating structures represented by the following formula (6)

(6)

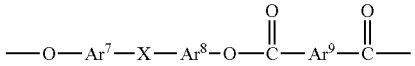

wherein $Ar^7$, $Ar^8$, and $Ar^9$ each independently represent an arylene group which may have one or more substituents, and X represents a direct bond between $Ar^7$ and $Ar^8$ or a divalent connecting group.

* * * * *